US011724899B2

(12) United States Patent
Takane et al.

(10) Patent No.: US 11,724,899 B2
(45) Date of Patent: Aug. 15, 2023

(54) SHEET CONVEYANCE APPARATUS AND IMAGE FORMING APPARATUS

(71) Applicant: CANON KABUSHIKI KAISHA, Tokyo (JP)

(72) Inventors: Ryota Takane, Toride (JP); Yasuhiro Takeichi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 317 days.

(21) Appl. No.: 16/671,642

(22) Filed: Nov. 1, 2019

(65) Prior Publication Data

US 2020/0156890 A1 May 21, 2020

(30) Foreign Application Priority Data

Nov. 20, 2018 (JP) ..... JP2018-217708

(51) Int. Cl.
*B65H 9/00* (2006.01)
*B65H 5/06* (2006.01)

(52) U.S. Cl.
CPC ..... *B65H 9/002* (2013.01); *B65H 5/062* (2013.01); *B65H 9/006* (2013.01);
(Continued)

(58) Field of Classification Search
CPC ..... B65H 9/002; B65H 9/006; B65H 5/062; B65H 2404/1441; B65H 2404/144; B65H 2511/11; B65H 2511/224; B65H 2511/112
See application file for complete search history.

(56) References Cited

U.S. PATENT DOCUMENTS 6,460,687 B1 * 10/2002 Escobedo ..... B41J 15/005 198/624
7,540,496 B2 * 6/2009 Fukushima ..... G03B 27/587 271/253

(Continued)

FOREIGN PATENT DOCUMENTS

CN 1757586 A 4/2006
JP H1179474 A 3/1999

(Continued)

OTHER PUBLICATIONS

Office Action issued in Chinese Appln. No. 201911133283.6 dated Nov. 19, 2021. English translation provided.

*Primary Examiner* — Patrick Cicchino
(74) *Attorney, Agent, or Firm* — ROSSI, KIMMS & McDOWELL LLP

(57) ABSTRACT

A first roller pair disposed upstream of a second roller pair is separated from each other by a separating mechanism. A control portion is configured to start rotating the second roller pair after a leading edge of a sheet in a sheet conveyance direction is abutted against the second roller pair in a stopped condition. The control portion is configured to execute, based on the information concerning the sheet length acquired by the acquisition portion, either one of a plurality of modes including a first mode of rotating an upstream roller pair and the first roller pair to convey the sheet while the first roller pair is in a contact condition and a second mode of operating the separating mechanism to separate the first roller pair and of rotating the upstream roller pair to convey the sheet while the first roller pair is in a separated condition.

14 Claims, 15 Drawing Sheets

(52) U.S. Cl.
CPC .. *B65H 2404/1441* (2013.01); *B65H 2407/21* (2013.01); *B65H 2511/11* (2013.01); *B65H 2511/224* (2013.01); *B65H 2515/10* (2013.01)

(56) References Cited

U.S. PATENT DOCUMENTS

| | | | | |
|---|---|---|---|---|
| 8,770,581 | B2 * | 7/2014 | Deno | B65H 9/002 271/228 |
| 8,985,578 | B2 * | 3/2015 | Muneyasu | G03G 15/6567 271/227 |
| 9,340,385 | B2 * | 5/2016 | Deno | B65H 9/06 |
| 9,383,707 | B2 * | 7/2016 | Ogino | G03G 15/6558 |
| 9,388,000 | B2 * | 7/2016 | Hijikata | B65H 1/08 |
| 9,738,474 | B2 * | 8/2017 | Koizumi | B65H 7/10 |
| 9,850,088 | B2 * | 12/2017 | Maeda | B65H 9/004 |
| 10,106,355 | B2 * | 10/2018 | Sato | B65H 7/00 |
| 2003/0085505 | A1 | 5/2003 | Inoue | |
| 2013/0134663 | A1 | 5/2013 | Deno | |
| 2013/0320616 | A1 * | 12/2013 | Nakagaki | B65H 5/062 271/227 |
| 2015/0108706 | A1 * | 4/2015 | Watanabe | B65H 5/068 271/3.18 |

FOREIGN PATENT DOCUMENTS

| | | | |
|---|---|---|---|
| JP | 2003118891 | A | 4/2003 |
| JP | 2005324900 | A | 11/2005 |
| JP | 2014005147 | A | 1/2014 |
| JP | 2014061957 | A | 4/2014 |
| JP | 2015196594 | A | 11/2015 |
| JP | 2016102012 | A | 6/2016 |
| JP | 2019026452 | A | 2/2019 |

* cited by examiner

FIG.10

| SHEET LENGTH IN CONVEYANCE DIRECTION | GRAMMAGE OF SHEET | BEFORE CORRECTING SKEW | AFTER CORRECTING SKEW |
|---|---|---|---|
| X [mm] OR MORE | M[gsm] OR MORE | CONTACT | CONTACT |
| | UNDER M [gsm] | SEPARATE | SEPARATE |
| UNDER X [mm] | M[gsm] OR MORE | CONTACT | CONTACT |
| | UNDER M [gsm] | CONTACT | CONTACT |
| INDEFINITE (FREE-SIZE) | M[gsm] OR MORE | CONTACT | CONTACT |
| | UNDER M [gsm] | CONTACT | SEPARATE |

SHEET CONVEYANCE APPARATUS AND IMAGE FORMING APPARATUS

BACKGROUND OF THE INVENTION

Field of the Invention

The present invention relates to a sheet conveyance apparatus conveying a sheet and an image forming apparatus forming an image on the sheet.

Description of the Related Art

A technology of correcting a skew feed of a sheet by deflecting the sheet by butting a leading edge of the sheet against a registration roller pair in a stopped condition is widely used in a sheet conveyance apparatus mounted in an image forming apparatus such as a printer, a copier, a multi-function printer and the like. In such configuration, there is a case where the sheet is twisted along with the skew feed correction between the registration roller pair and a conveyance roller pair nipping the sheet upstream of the registration roller pair. If the registration roller pair starts to rotate in such situation, there is a case where the twisted part is nipped by the registration roller pair, thus causing a wrinkle on the sheet.

Japanese Patent Application Laid-open No. 11-79474 discloses a technology of temporarily separating the conveyance roller pair disposed upstream of the registration roller pair after correcting a skew by butting a leading edge of the sheet against the registration roller pair and after the registration roller pair starts to rotate. According to this document, it is possible to reduce a wrinkle from being generated because distortion of the sheet caused by the skew feed correction is eliminated by releasing a grip of the conveyance roller pair.

According to the abovementioned document, however, an operation of separating the conveyance roller pair and an operation of contacting the separated conveyance roller pair again are executed every time when one sheet is conveyed. Therefore, the operations of separating and contacting the conveyance roller pair are uniformly executed even in a case where a possibility of causing a wrinkle is actually very small. This fact often becomes a factor of dropping a throughput of the sheet conveyance apparatus. For instance, in a case where a driving source for rotating the conveyance roller pair operates also as a driving source for separating the conveyance roller pair, a sheet conveyance operation is temporarily stopped during when the operations of separating or contacting the conveyance roller pair are executed.

SUMMARY OF THE INVENTION

The prevent invention provides a sheet conveyance apparatus and an image forming apparatus capable of preventing wrinkle of a sheet and suppressing drop in throughput.

According to one aspect of the invention, a sheet conveyance apparatus includes: a first roller pair configured to convey a sheet; a second roller pair disposed downstream of the first roller pair in a sheet conveyance direction and configured to convey the sheet; an upstream roller pair disposed upstream of the first roller pair in the sheet conveyance direction and configured to convey the sheet; a separating mechanism configured to separate the first roller pair from each other; an acquisition portion configured to acquire information concerning a sheet length of the sheet in the sheet conveyance direction; and a control portion configured to start rotating the second roller pair after a leading edge of the sheet in the sheet conveyance direction is abutted against the second roller pair in a stopped condition, the control portion being configured to execute, based on the information concerning the sheet length of the sheet acquired by the acquisition portion, either one of a plurality of modes including a first mode of rotating the upstream roller pair and the first roller pair to convey the sheet while the first roller pair is in a contact condition so that the leading edge of the sheet is abutted against the second roller pair in the stopped condition and a second mode of operating the separating mechanism to separate the first roller pair and of rotating the upstream roller pair to convey the sheet while the first roller pair is in a separated condition so that the leading edge of the sheet is abutted against the second roller pair in the stopped condition.

According to another aspect of the invention, an image forming apparatus includes: an image forming unit configured to form an image on a sheet; and a sheet conveyance apparatus configured to convey the sheet to the image forming unit, wherein the sheet conveyance apparatus includes: a first roller pair configured to convey a sheet; a second roller pair disposed downstream of the first roller pair in a sheet conveyance direction and configured to convey the sheet; an upstream roller pair disposed upstream of the first roller pair in the sheet conveyance direction and configured to convey the sheet; a separating mechanism configured to separate the first roller pair from each other; an acquisition portion configured to acquire information concerning a sheet length of the sheet in the sheet conveyance direction; and a control portion configured to start rotating the second roller pair after a leading edge of the sheet in the sheet conveyance direction is abutted against the second roller pair in a stopped condition, the control portion being configured to execute, based on the information concerning the sheet length of the sheet acquired by the acquisition portion, either one of a plurality of modes including a first mode of rotating the upstream roller pair and the first roller pair to convey the sheet while the first roller pair is in a contact condition so that the leading edge of the sheet is abutted against the second roller pair in the stopped condition and a second mode of operating the separating mechanism to separate the first roller pair and of rotating the upstream roller pair to convey the sheet while the first roller pair is in a separated condition so that the leading edge of the sheet is abutted against the second roller pair in the stopped condition.

According to still another aspect of the invention, a sheet conveyance apparatus includes: a sheet supporting portion configured to support a sheet; a first roller pair configured to convey the sheet fed from the sheet supporting portion; a second roller pair disposed downstream of the first roller pair in a sheet conveyance direction and configured to convey the sheet; an upstream roller pair disposed upstream of the first roller pair in the sheet conveyance direction and configured to convey the sheet; a separating mechanism configured to separate the first roller pair from each other; a regulating portion configured to be in contact with an edge of the sheet supported on the sheet supporting portion in a width direction and regulate a position of the sheet in the width direction; a detection portion configured to detect a position of the regulating portion in the width direction; an input portion enabling to input information concerning a sheet width of the sheet in the width direction; and a control portion configured to control a conveyance operation of starting to rotate the second roller pair after a leading edge of the sheet in the sheet conveyance direction is abutted against the second roller pair in a stopped condition, the control portion being configured to execute, based on the sheet width inputted through the input portion and the position of the regulating portion detected by the detection portion, either one of a plurality of modes including a first mode of rotating the upstream roller pair and the first roller pair to convey the sheet in a condition in which the first roller pair is in a contact condition so that the leading edge of the sheet is abutted against the second roller pair in the stopped condition and a second mode of operating the separating mechanism to separate the first roller pair and of rotating the upstream roller pair to convey the sheet in a condition in which the first roller pair is separated so that the leading edge of the sheet is abutted against the second roller pair in the stopped condition.

Further features of the present invention will become apparent from the following description of exemplary embodiments with reference to the attached drawings.

BRIEF DESCRIPTION OF THE DRAWINGS

FIG. 10 is a table for making a decision for contacting or separating the pre-registration roller pair of the first embodiment.

DESCRIPTION OF THE EMBODIMENTS

Exemplary embodiments of the present disclosure will be described below with reference to the drawings.

First Embodiment

Figure 1:
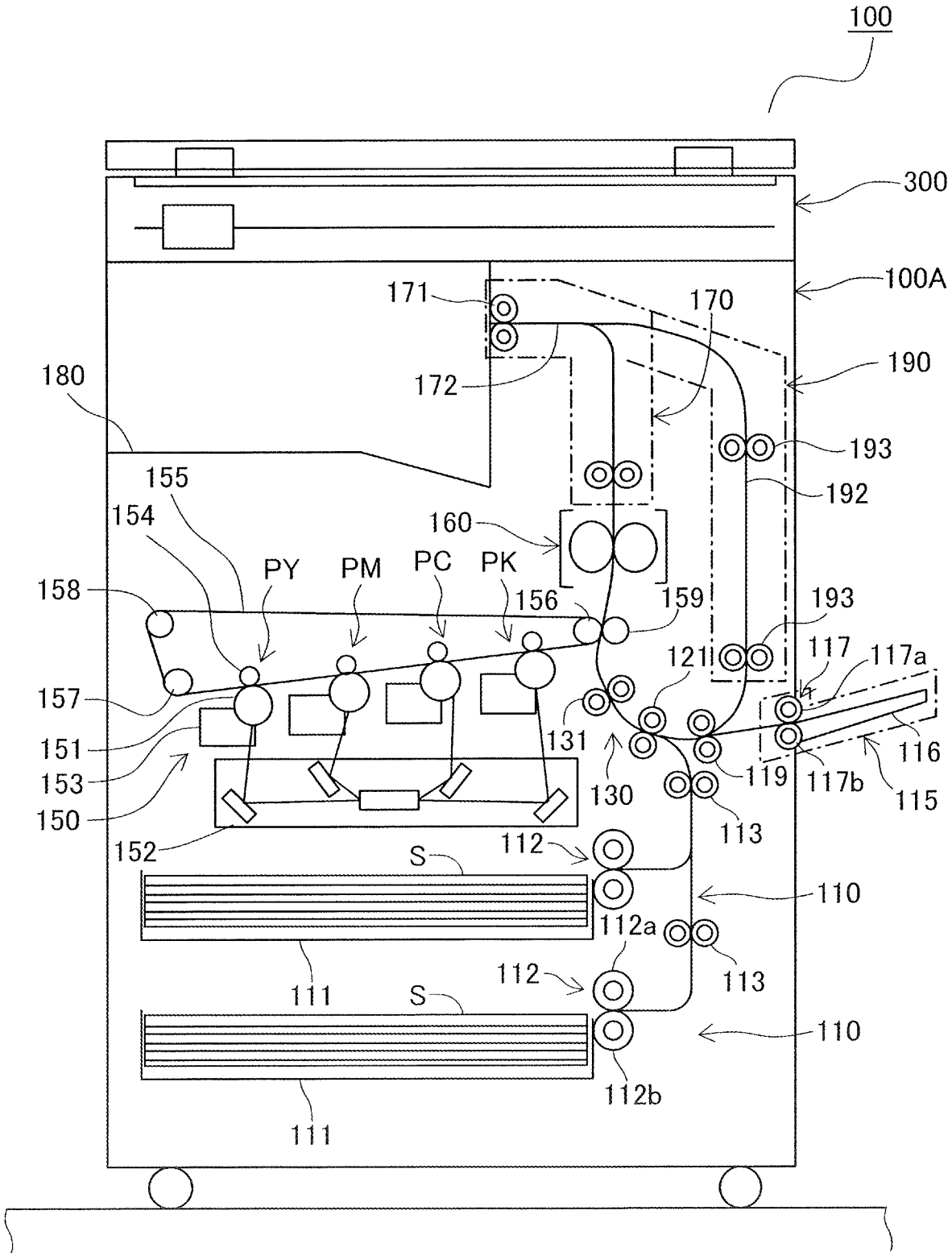
FIG. 1 is a schematic diagram illustrating an image forming apparatus of a first embodiment.

FIG. 1 is a schematic diagram of an image forming apparatus 100 of a first embodiment. The image forming apparatus 100 forms an image on a sheet serving as a recording medium based on image information inputted from an external personal computer or read from a document. The sheet serving as the recording medium includes a sheet of paper, a sheet for an envelope, a plastic film for an overhead projector and a cloth.

The image forming apparatus 100 includes an apparatus body 100A storing an image forming unit 150 and an image reading apparatus 300 disposed above the apparatus body 100A and reading image information from a document. The image forming unit 150 serving as an exemplary image forming unit is an intermediate transfer type electro-photographic unit including four image forming stations PY, PM, PC and PK, an intermediate transfer belt 155 and a fixing unit 160.

Each of the image forming stations PY through PK forms a toner image on a surface of a photosensitive drum 151 by executing an electro-photographic process. That is, when each of the image forming stations PY through PK is required to form the toner image, the photosensitive drum 151 serving as a photosensitive member is rotationally driven such that a charging unit homogeneously charges the surface of the photosensitive drum 151. An exposing unit 152 provided at a lower part of the apparatus body 100A exposes the surface of the photosensitive drum 151 by irradiating the photosensitive drum 151 with a laser beam based on image information to draw an electrostatic latent image on the photosensitive drum 151. A developing unit 153 supplies the photosensitive drum 151 with charged toner particles to develop the electrostatic latent image on the drum surface as a toner image. The toner images of respective colors formed by the image forming stations PY through PK are primarily transferred from the photosensitive drums 151 to the intermediate transfer belt 155 by primary transfer rollers 154. Adhesive materials such as toner left on the photosensitive drums 151 are removed by cleaning units provided in the respective image forming stations PY through PK.

The intermediate transfer belt 155 serving as an intermediate transfer member is wound around a secondary transfer inner roller 156, a tension roller 157 and a stretch roller 158 and is rotationally driven counterclockwise in FIG. 1. The toner image borne on the intermediate transfer belt 155 is secondarily transferred to a sheet S at a secondary transfer portion defined between a secondary transfer roller 159 facing the secondary transfer inner roller 156 and the intermediate transfer belt 155. Adhesives such as toner left on the intermediate transfer belt 155 are removed by a belt cleaning unit.

The sheet S onto which the toner image has been transferred is passed to the fixing unit 160. The fixing unit 160 serving as a fixing unit of the present embodiment includes a fixing roller serving as a rotary member conveying the sheet S, a pressure roller nipping the sheet S together with the fixing roller and a heat source such as a halogen heater heating the fixing roller. The fixing unit 160 melts toner of the toner image by applying heat and pressure to the toner image while conveying the sheet S and then the toner image is fixed onto the sheet S as the toner adheres to the sheet.

In parallel with such image forming process, the sheet S is fed one by one from any one of cassette sheet feed portions 110 or a multi sheet feed portion 115 toward the image forming unit 150. The cassette sheet feed portion 110 each includes a sheet feed cassette 111 serving as a sheet supporting portion and a sheet feed unit 112 feeding the sheet S from the sheet feed cassette 111. A multi sheet feed portion 115 also includes a multi-purpose tray 116 which is another example of the sheet supporting portion and a sheet feed unit 117 feeding the sheet S set on the multi-purpose tray 116. The sheet feeding units 112 and 117 include feed rollers 112*a* and 117*a* feeding the sheet S and separation rollers 112*b* and 117*b* separating the sheet S conveyed by the feed rollers 112*a* and 117*a* from other sheets. It is noted that each of the sheet feeding units 112 and 117 is an exemplary sheet feeding unit and may be replaced with other mechanisms such as a separation pad system and an air feeding system. The multi-purpose tray 116 is also called as a multi tray or a manual feed tray in general.

The sheet S fed by the sheet feeding unit 112 or 117 is conveyed to a skew feed correcting portion 130 via drawing roller pair 113 or 119. The skew feed correcting portion 130 of the present embodiment is composed of a pre-registration roller pair 121 and a registration roller pair 131. As described later in detail, the skew feed correcting portion 130 corrects a skew of the sheet S and sends the sheet S to the secondary transfer portion at a timing synchronized with a progress of the image forming process of the image forming unit 150.

The sheet S on which the image has been formed by passing through the secondary transfer portion and the fixing unit 160 is conveyed to a discharge roller pair 171 through a discharge path 172 in a sheet discharge portion 170. In a case of simplex printing, the sheet S is discharged by the discharge roller pair 171 to a sheet discharge tray 180 provided between the apparatus body 100A and the image reading apparatus 300. In a case of duplex printing, the sheet S in which the image has been formed on a first surface thereof is reversely conveyed or is switched back by the discharge roller pair 171 to be delivered to a duplex conveyance portion 190 and is conveyed by a conveyance roller pairs 193 and 193 through a duplex path 192. Then, the sheet S arrives again at the skew feed correcting portion 130 and an image is formed by the image forming unit 150 on a second surface thereof. Then, the sheet S is discharged by the discharge roller pair 171 to the sheet discharge tray 180.

In the abovementioned description, the image forming unit 150 is just one example of the image forming unit, and another image forming unit such as a direct transfer type electro-photographic unit or an inkjet type or offset printing type image forming unit may be used.

Control System

Figure 2:
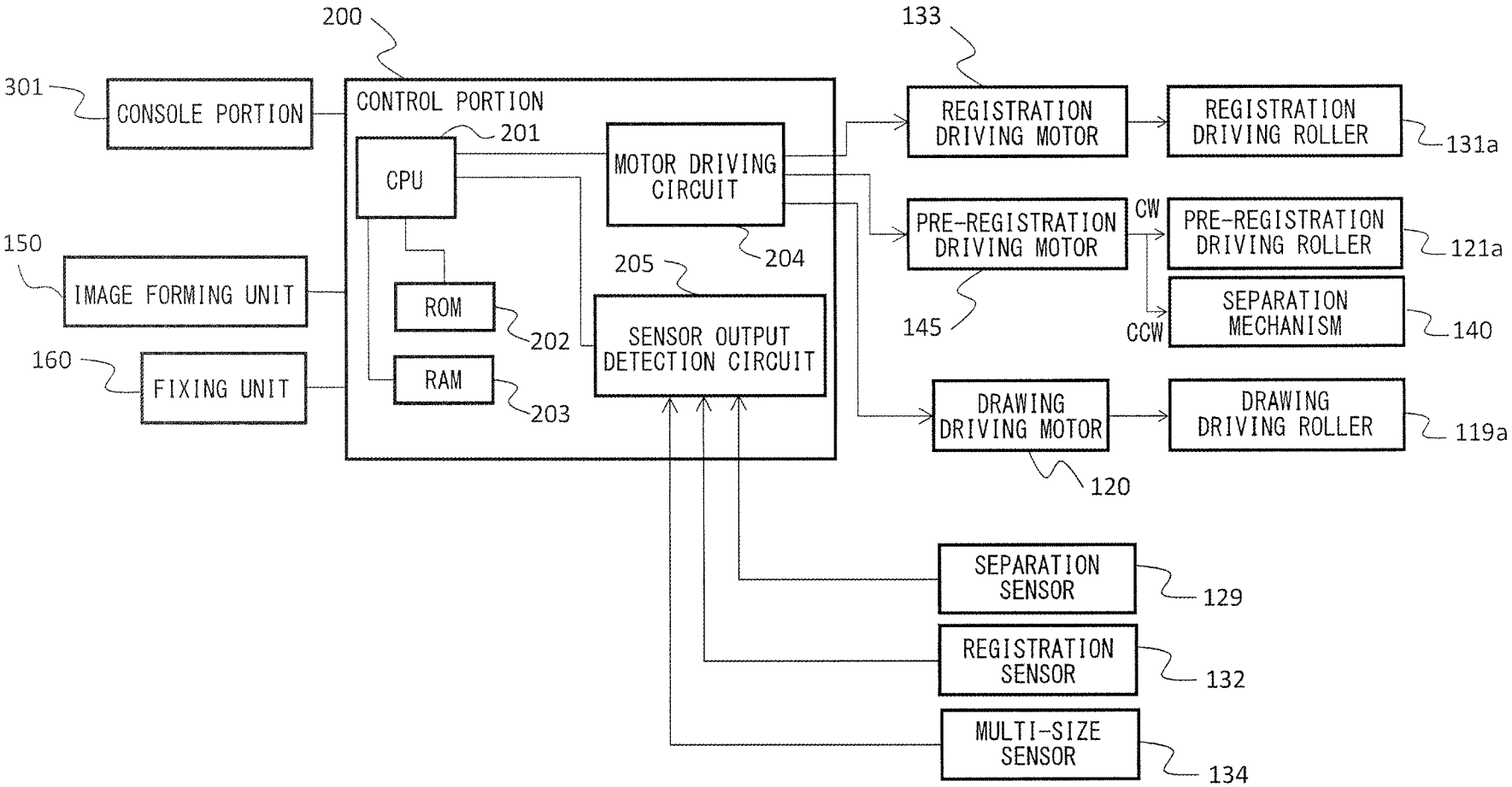
FIG. 2 is a block diagram of a control system of the image forming apparatus of the first embodiment.

FIG. 2 is a block diagram illustrating a control system of the image forming apparatus 100. A control unit 200 serving as the control portion of the present embodiment is mounted in the apparatus body 100A of the image forming apparatus 100. The control unit 200 includes at least one processor including a central processing unit (CPU) 201, a non-temporary storage unit including a read-only memory (ROM) 202 and a temporary storage unit including a random access memory (RAM) 203. The CPU 201 reads and executes a program stored in the ROM 202 and others to control operations of the entire image forming apparatus. For instance, the CPU 201 controls a toner image forming process of the image forming unit 150 and temperature of the fixing unit 160 by transmitting command signals to the image forming unit 150 and the fixing unit 160. The storage units such as the ROM 202 and the RAM 203 become storage areas of the program and data and also become workspaces when the CPU 201 executes the program.

The CPU 201 transmits a driving signal to a motor driving circuit 204 driving a registration driving motor 133 rotating the registration roller pair 131, a pre-registration driving motor 145 rotating the pre-registration roller pair 121, and the drawing driving motor 120 rotating a drawing roller pair 119. The registration driving motor 133 is connected with a registration driving roller 131*a* serving as a driving roller of the registration roller pair 131, and the pre-registration driving motor 145 is connected with a pre-registration driving roller 121*a* serving as a driving roller of the pre-registration roller pair 121. The drawing driving motor 120 is also connected with a drawing driving roller 119*a* serving as a driving roller of the drawing roller pair 119.

The motor driving circuit 204 that has received the driving signal supplies power to each motor. Note that the pre-registration driving motor 145 serves also as a driving source for actuating a separating mechanism 140 of the pre-registration roller pair 121 and is capable of turning in a first direction and to a second direction opposite to the first direction. The CPU 201 transmits the driving signal not only designating a rotation speed but also designating a rotation direction as for the pre-registration driving motor 145 so that the motor driving circuit 204 rotates the pre-registration driving motor 145 in the designated rotation direction.

A sensor output detecting circuit 205 detects output signals of various sensors 129, 132 and 134 used to control the sheet conveyance operation of the present embodiment. For instance, in a case of using a photoelectric sensor having a light emitting element and a light receiving element as a sensor and in a case where an output signal of the sensor indicates that a light receiving amount is a threshold value or more, the sensor output detecting circuit 205 outputs a high level signal, i.e., an ON signal. Meanwhile, in a case where an output signal of the sensor indicates that a light receiving amount is less than a threshold value, the sensor output detecting circuit 205 outputs a low level signal, i.e., an OFF signal. While the case where the sensor output detecting circuit 205 outputs a two-level signal has been exemplified here, it is also possible to arrange such that the sensor output detecting circuit 205 outputs a multi-value signal corresponding to an output signal of the sensor. A signal outputted from the sensor output detecting circuit 205 corresponding to the output signal of the sensor will be handled as a detection result of each sensor hereinafter.

A separation sensor 129 is a sensor for detecting a condition of the separating mechanism 140. The separation sensor 129 is configured to turn ON in a case where the pre-registration roller pair 121 is in a separate condition and to turn OFF in a case where the pre-registration roller pair 121 is in a contact condition. A registration sensor 132 is a sensor for detecting an arrival of a sheet to the registration roller pair 131 and is turned ON in a case of detecting the sheet at a detection position and is turned OFF in a case of detecting no sheet.

A multi-size sensor 134 is one example of a sensor capable of detecting size of the sheet supported on the sheet supporting portion. The multi-size sensor 134 of the present embodiment detects a distance, in a width direction of the sheet, between a pair of side regulating plates (regulating portion in the present embodiment) disposed in the multi-purpose tray 116 in FIG. 1. The CPU 201 can recognize a width of the sheet supported on the multi-purpose tray 116 based on the detection result of the multi-size sensor 134.

The control unit 200 is also connected with a console portion 301 serving as a user interface of the image forming apparatus 100. The console portion 301 includes a display unit serving as a display portion displaying information for the user, physical keys and a touch panel function of the display unit serving as an input portion enabling to input information by receiving an input operation of the user. The control unit 200 transmits a command signal to the console portion 301 to cause the display unit to display information in a form such as an image and/or a text message. Information inputted to the console portion 301 such as sheet information, setting information of printing conditions, a command instructing a start of an image forming operation and the like is transmitted to the control unit 200.

Skew Feed Correcting Portion

Figure 3:
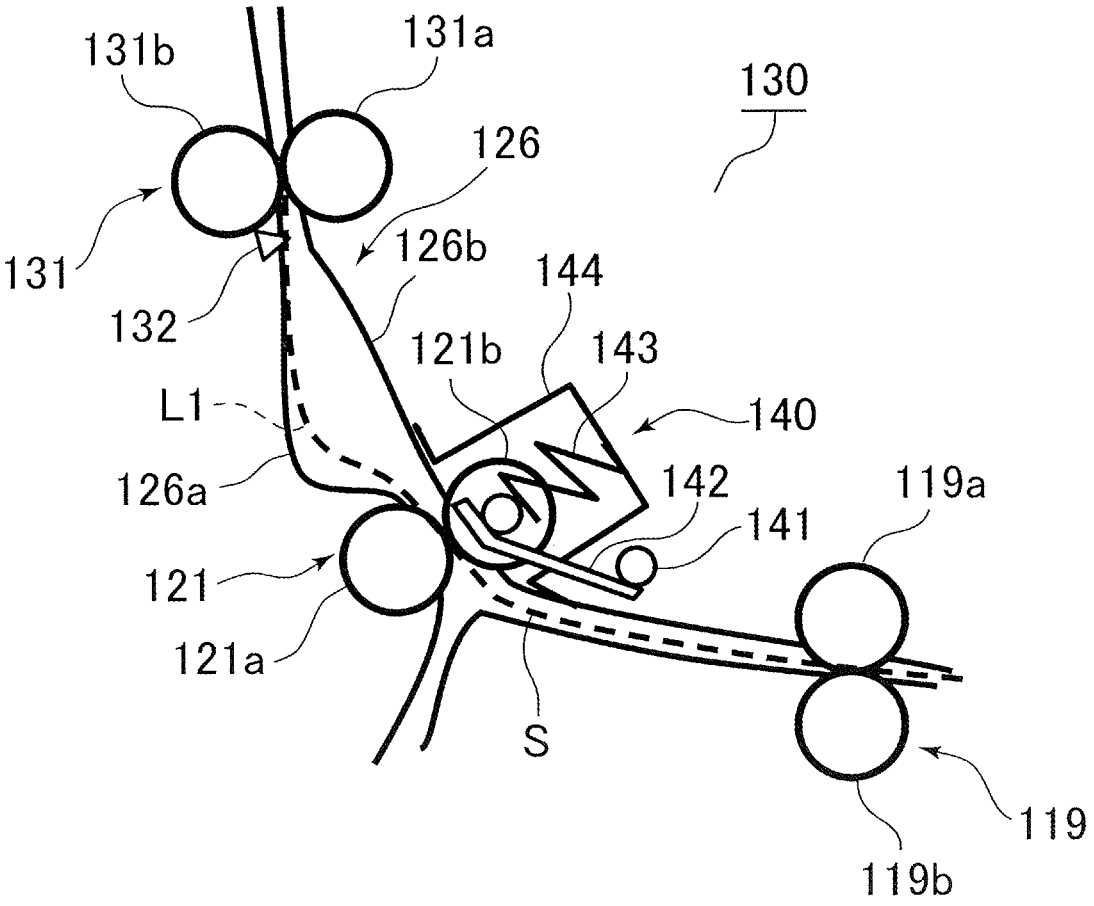
FIG. 3 is a schematic diagram illustrating a condition in which a pre-registration roller pair of the first embodiment is in contact.

Next, a configuration and operations of the skew feed correcting portion 130 of the first embodiment will be described with reference to FIGS. 3 and 4 which are schematic diagrams illustrating the skew feed correcting portion 130. FIG. 3 illustrates the pre-registration roller pair 121 in a contact condition and FIG. 4 illustrates the pre-registration roller pair 121 in a separate condition.

Figure 4:
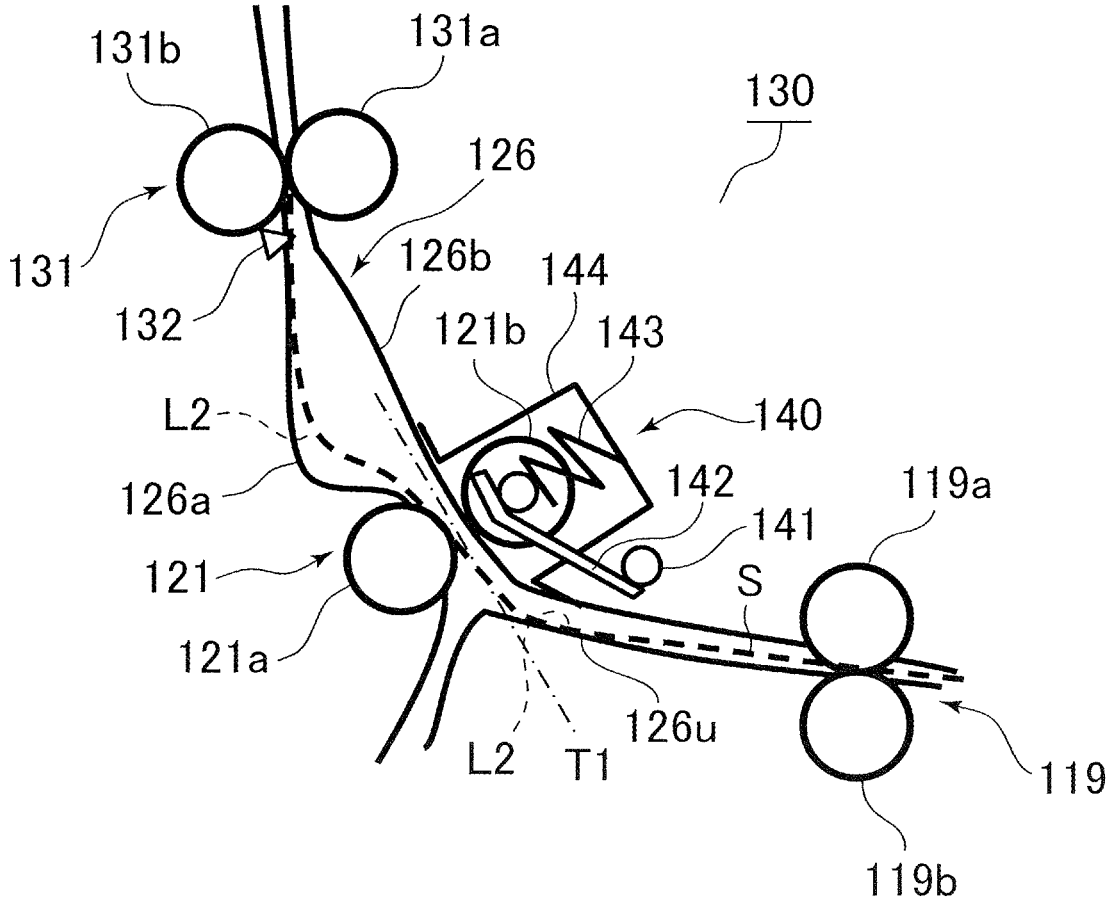
FIG. 4 is a schematic diagram illustrating a condition in which the pre-registration roller pair of the first embodiment is separated.

As illustrated in FIGS. 3 and 4, the skew feed correcting portion 130 includes a registration roller pair 131 and the pre-registration roller pair 121 disposed upstream of the registration roller pair 131. Still further, in a case where the sheet S is fed from the multi sheet feed portion 115, a drawing roller pair 119 is disposed further upstream of the pre-registration roller pair 121. A direction along a conveyance path of the sheet S from the drawing roller pair 119 to the registration roller pair 131 via the pre-registration roller pair 121 will be referred to as a sheet conveyance direction hereinafter. The pre-registration roller pair 121 is a first roller pair and the registration roller pair 131 is a second roller pair of the present embodiment. The drawing roller pair 119 is an upstream roller pair or a third roller pair provided upstream of the first roller pair in the present embodiment.

The drawing roller pair 119 is composed of a drawing driving roller 119*a* and a drawing driven roller 119*b* that is driven by the drawing driving roller 119*a*, and nips and conveys the sheet received from the sheet feed unit 117 of the multi sheet feed portion 115 in FIG. 1. The pre-registration roller pair 121 is composed of the pre-registration driving roller 121*a* and a pre-registration driven roller 121*b* that is driven by the pre-registration driving roller 121*a*, and nips and conveys the sheet received from the drawing roller pair 119. The pre-registration roller pair 121 can be switched, by a separating mechanism 140 described later, over the contact condition in which the pre-registration driving roller 121*a* is in contact with the pre-registration driven roller 121*b* so as to define a nip portion and the separate condition in which the nip portion is opened. The registration roller pair 131 is composed of a registration driving roller 131*a* and a registration driven roller 131*b* and nips the sheet S to convey to the secondary transfer portion.

The skew feed correcting portion 130 is also provided with a registration sensor 132 capable of detecting the sheet S at a detection position between the pre-registration roller pair 121 and the registration roller pair 131. A reflection type photoelectric sensor projecting light to the sheet conveyance path and being capable of detecting a reflection light from the sheet S or a transmission type photoelectric sensor detecting a pivot operation of a flag projecting on the sheet conveyance path may be used as the registration sensor 132.

In the sheet conveyance operation, the leading edge of the sheet sent out of the pre-registration roller pair 121 or the leading edge of the sheet sent out of the drawing roller pair 119 and passing through the pre-registration roller pair 121 in the separate condition is abutted against the registration roller pair 131 in the stopped condition. Thereby, the sheet S bends and forms a loop when viewed from a width direction of the sheet orthogonal to the sheet conveyance direction and the leading edge of the sheet follows the nip portion of the registration roller pair 131. Thus, a skew feed of the sheet is corrected.

As illustrated in FIG. 3, a conveyance guide 126 defining the sheet conveyance path of the skew feed correcting portion 130 is composed of a first guide 126*a* facing one surface of the sheet S and a second guide 126*b* facing another surface of the sheet S. The conveyance guide 126 defines a loop space that permits the sheet S to form a loop L1 between the pre-registration roller pair 121 and the registration roller pair 131. In other words, the first guide 126*a* has a shape expanding so as to be distant from a line segment connecting the nip portion of the pre-registration roller pair 121 and the nip portion of the registration roller pair 131 when viewed from the sheet width direction and is disposed so as to be located outside of the bent sheet.

By the way, along with divergence of the sheet to be used as a recording medium, the sheet conveyance apparatus used in the image forming apparatus is required to be able to stably convey various size sheets. More specifically, there is a case where a distance between conveyance roller pairs in a sheet conveyance direction is narrowly set such that a small sheet such as a postcard is securely passed from an upstream conveyance roller pair to a downstream conveyance roller pair. In the case of the present embodiment, distances between the drawing roller pair 119 and the pre-registration roller pair 121 and between the pre-registration roller pair 121 and the registration roller pair 131 in the sheet conveyance direction are all configured to be shorter than a minimum size sheet that is supported by the image forming apparatus 100.

Figure 11:
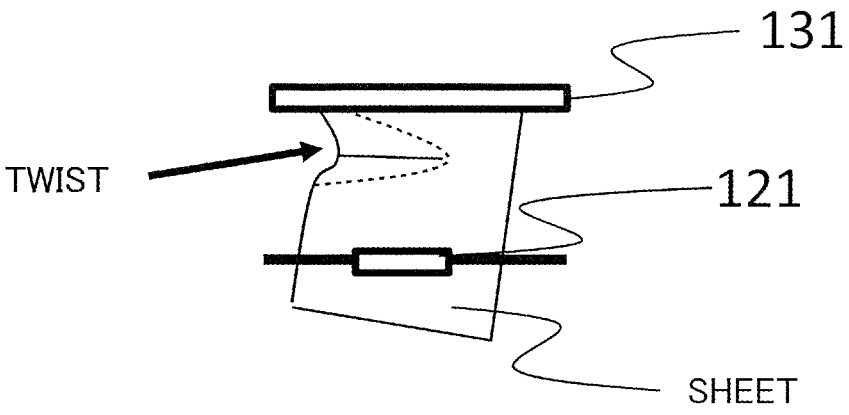
FIG. 11 is a schematic diagram illustrating a twist of the sheet.

However, in the configuration in which the distance between the pre-registration roller pair 121 and the registration roller pair 131 is shortened as described above, there is a possibility that the sheet S causes a wrinkle when the sheet S is started to be conveyed by the registration roller pair 131. That is, in a condition before the registration roller pair 131 starts to rotate, the sheet forms a loop as the leading edge of the sheet is abutted against the registration roller pair 131 in the stopped condition. In a case where the sheet is fed askew before forming a loop as illustrated in FIG. 11, the sheet S butting against the registration roller pair 131 forms a loop asymmetric about the width direction thereof. If the registration roller pair 131 starts to rotate in such a condition in which the sheet is twisted, a part of the sheet asymmetrically deformed may generate a wrinkle by being nipped by the registration roller pair 131.

The wrinkle caused by the twist of the sheet is liable to occur in conveying a sheet having less rigidity or small strength such as a thin sheet having a small grammage. Still further, the longer the length of the sheet in the sheet conveyance direction, the higher the rate of incidence of the wrinkle tends to be. It is because in a case where the sheet is askew before correcting the skew, a position of a part of the sheet nipped by the pre-registration roller pair 121 gradually shifts in the width direction, i.e., to the left in FIG. 11, as the pre-registration roller pair 121 rotates. As a gap between a sheet position at the registration roller pair 131 and a sheet position at the pre-registration roller pair 121 increases as the sheet is conveyed, the twist of the sheet increases and the sheet is liable to be wrinkled as a result.

Then, according to the present embodiment, the pre-registration roller pair 121 is separated as necessary to reduce the possibility of causing the wrinkle when the registration roller pair 131 starts to convey the sheet S. To that end, the skew feed correcting portion 130 is provided with the separating mechanism 140 for switching the pre-registration roller 121 over the contact condition as illustrated in FIG. 3 and the separate condition as illustrated in FIG. 4.

As illustrated in FIGS. 3 and 4, the separating mechanism 140 includes a separation arm 142 that swings centering on a separation shaft 141 and causes the pre-registration roller pair 121 to come in contact and to separate from each other by moving a roller shaft of the pre-registration driven roller 121*b*. Note that a pressure spring 143 serving as an elastic member is provided between the roller shaft of the pre-registration driven roller 121*b* and a sheet metal 144 fixed to a frame member of the image forming apparatus 100 and urges the pre-registration driven roller 121*b* to come into pressure contact with the pre-registration driving roller 121*a*.

Figure 5:
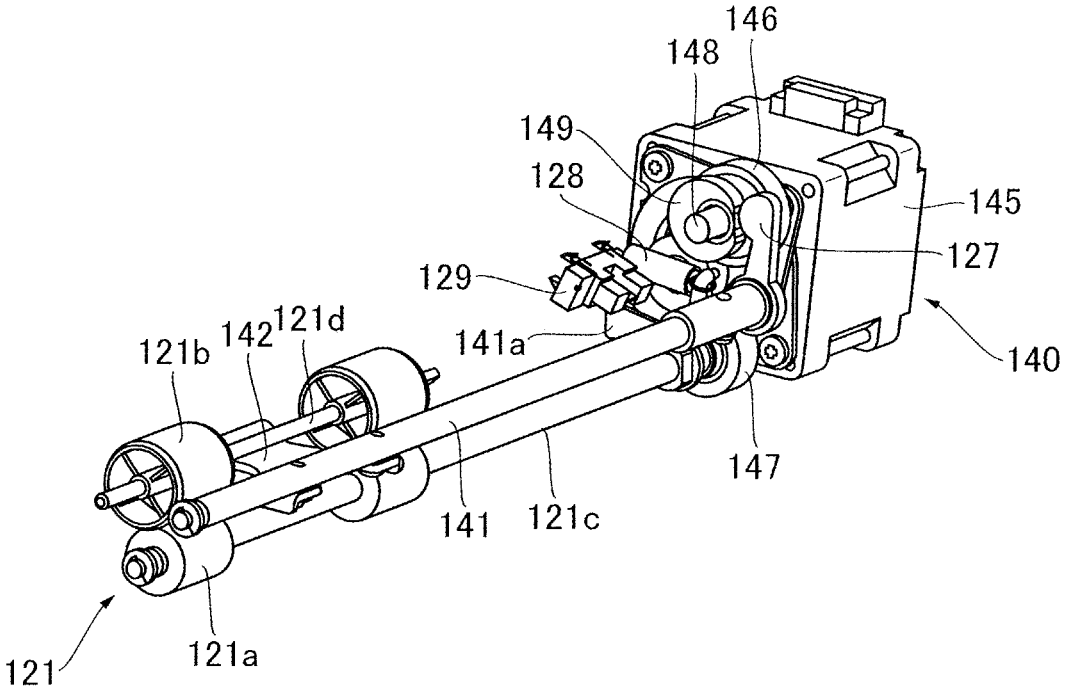
FIG. 5 is a perspective view illustrating a driving mechanism of the pre-registration roller pair corresponding to the condition in which the pre-registration roller pair of the first embodiment is in contact.
Figure 6:
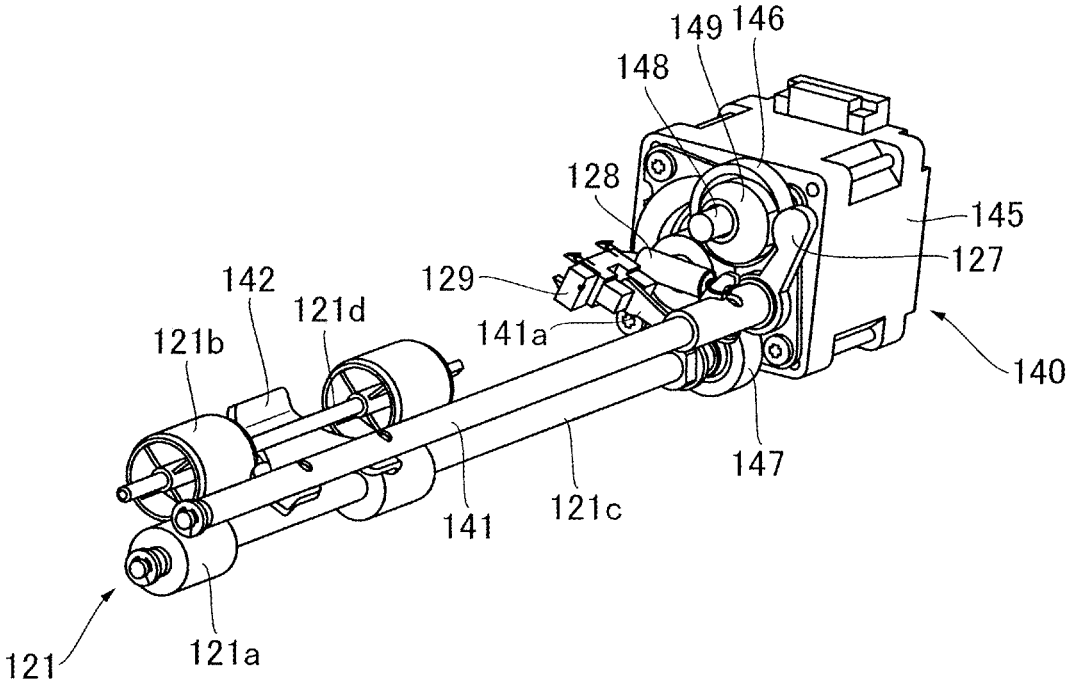
FIG. 6 is a perspective view illustrating the driving mechanism of the pre-registration roller pair corresponding to the condition in which the pre-registration roller pair of the first embodiment is separated.

FIGS. 5 and 6 are perspective views illustrating details of the separating mechanism 140, in which FIG. 5 illustrates the pre-registration roller pair 121 in the contact condition and FIG. 6 illustrates the pre-registration roller pair 121 in the separate condition. In addition to the separation shaft 141 and the separation arm 142, the separating mechanism 140 includes a separation gear 146, a separation transmission shaft 148, a cam 149, a lever 127, a positioning spring 128 and a separation sensor 129.

The separation gear 146 and the cam 149 are supported on the separation transmission shaft 148 and are rotated in a body by a driving force of the pre-registration driving motor 145. The cam 149 serving as a cam member pivots the separation shaft 141 by pressing the lever 127 connected with the separation shaft 141. The positioning spring 128 connected with the separation shaft 141 urges the separation shaft 141 so as to press the lever 127 to the cam 149. The separation arm 142 attached to the separation shaft 141 swings along with a move of the lever 127 and moves a rotation shaft 121*d* of the pre-registration driven roller 121*b* in a direction of approaching to or of separating from the pre-registration driving roller 121*a*. Thereby, when the cam 149 presses the lever 127 as illustrated in FIG. 6, the separation arm 142 moves the rotation shaft 121*d* and separates the pre-registration roller pair 121 while resisting against urging force of the pressure spring 143 as illustrated in FIG. 4. Meanwhile, when the pressure on the lever 127 caused by the cam 149 is released as illustrated in FIG. 5, the pre-registration roller pair 121 returns to the contact condition by urging force of the pressure spring 143 as illustrated in FIG. 3.

The separation sensor 129 is a transmission type photoelectric sensor capable of detecting a flag portion 141*a* provided on the separation shaft 141. The flag portion 141*a* is disposed such that a detection signal of the separation sensor 129 changes during when the separation shaft 141 pivots between an angle corresponding to the contact condition and an angle corresponding to the separate condition of the separation shaft 141. It is noted that the separation sensor 129 is just one exemplary sensor capable of detecting whether the pre-registration roller pair 121 is in contact or is separated and may be replaced with an arrangement of detecting a position of the rotation shaft 121*d* of the pre-registration driven roller 121*b* for example.

Figure 7:
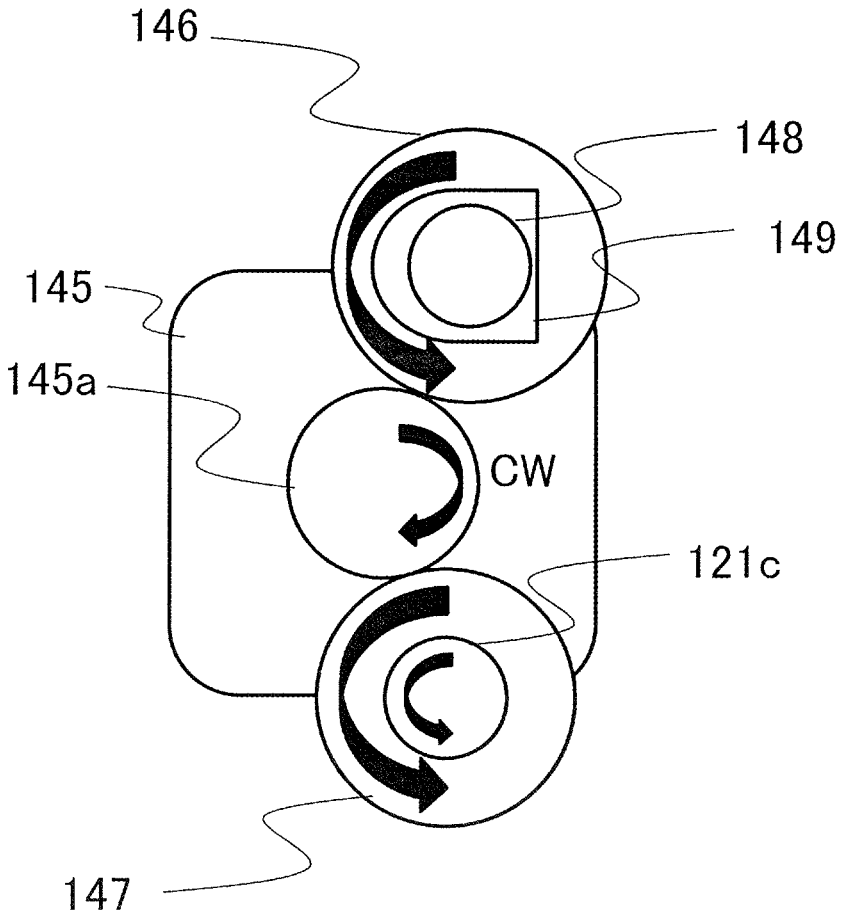
FIG. 7 is a schematic diagram of the driving mechanism in rotating the pre-registration roller pair of the first embodiment.
Figure 8:
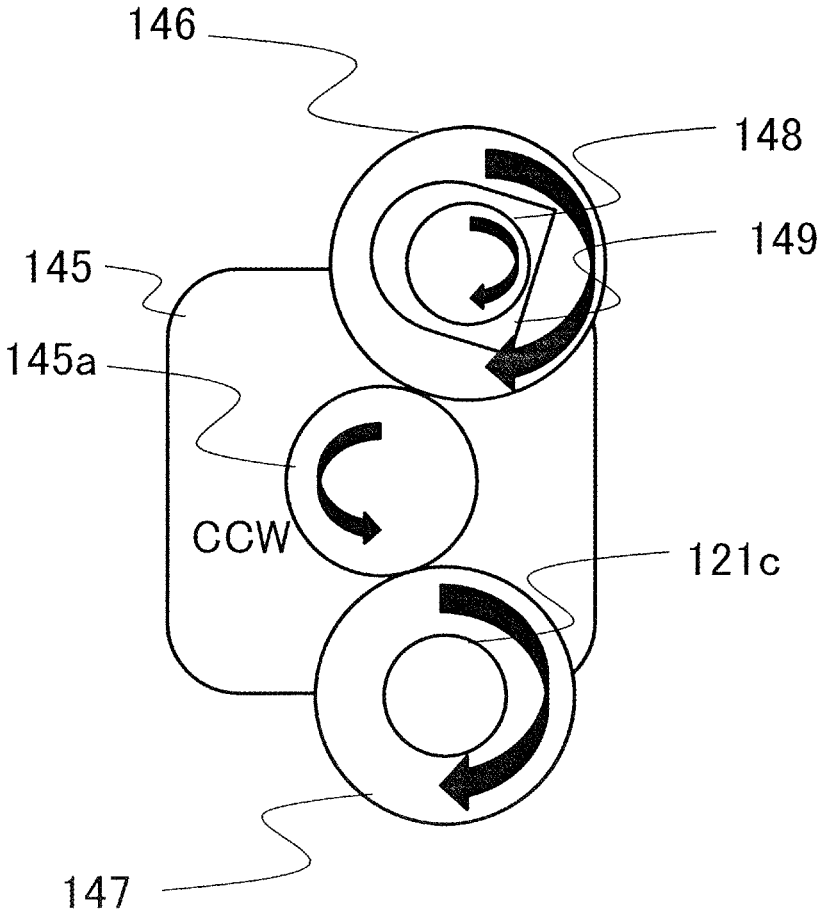
FIG. 8 is a schematic diagram of the driving mechanism in executing the separating operation of the pre-registration roller pair of the first embodiment.

As illustrated in FIGS. 7 and 8, an output gear 145*a* of the pre-registration driving motor 145 engages both of the separation gear 146 and the pre-registration driving gear 147 attached to a drive shaft 121*c* of the pre-registration driving roller 121*a*. As for rotation directions of the pre-registration driving motor 145, a clockwise direction when viewed from a direction in which an output shaft project will be denoted as a CW direction and a direction opposite to that direction, i.e., a counterclockwise direction, as a CCW direction. The CW direction is a first direction of the present embodiment and the CCW direction is a second direction of the present embodiment. The pre-registration driving gear 147 is provided with a one-way clutch mechanism which transmits a driving force of the drive shaft 121*c* when the output gear 145*a* rotates in the CW direction and idles when the output gear 145*a* rotates in the CCW direction. The separation gear 146 is also provided with one-way clutch mechanism that transmits a driving force of the separation transmission shaft 148 when the output gear 145*a* rotates in the CCW direction and idles when the output gear 145*a* rotates in the CW direction.

In a case where the pre-registration driving motor 145 rotates in the CW direction, i.e., the first direction, as illustrated in FIG. 7, the driving force is transmitted to the drive shaft 121*c* through the pre-registration driving gear 147 and the pre-registration roller pair 121 rotates. In this case, because no driving force is transmitted to the separation transmission shaft 148 and the separating mechanism 140 is not actuated, the contact condition or the separate condition of the pre-registration roller pair 121 is maintained.

Meanwhile, in a case where the pre-registration driving motor 145 rotates in the CCW direction, i.e., the second direction, as illustrated in FIG. 8, the driving force is transmitted to the separation transmission shaft 148 through the separation gear 146 and the contact condition and the separate condition of the pre-registration roller pair 121 is switched over by the separating mechanism 140. In this case, no driving force is transmitted to the drive shaft 121*c* and the pre-registration roller pair 121 is kept in a condition of not being driven. Thus, the driving configuration of the pre-registration roller pair 121 of the present embodiment is capable of switching over the rotational drive of the pre-registration roller pair 121 and the drive of the separating mechanism 140 by switching over the rotation directions of the pre-registration driving motor 145.

Next, behaviors of the sheet at the skew feed correcting portion 130 in the conditions in which the pre-registration roller pair 121 is in contact and is separated will be described with reference to FIGS. 3 and 4.

In a case where the pre-registration roller pair 121 is in the contact condition, the sheet S that has been conveyed by the drawing roller pair 119 is nipped and conveyed by the pre-registration roller pair 121 in the contact condition as illustrated in FIG. 3. Then, as the pre-registration roller pair 121 rotates by a predetermined amount after the leading edge of the sheet S is abutted against the nip portion of the registration roller pair 131 in the stopped condition, a loop L1 of the sheet S is formed between the pre-registration roller pair 121 and the registration roller pair 131.

Meanwhile, in a case where the pre-registration roller pair 121 is in the separate condition, a loop L2 of the sheet S is formed between the drawing roller pair 119 and the registration roller pair 131 as illustrated in FIG. 4. It is noted that, according to the present embodiment, there are both cases of forming the loop L2 by the drawing roller pair 119 in the condition in which the pre-registration roller pair 121 is separated in advance and of separating the pre-registration roller pair 121 after forming the loop in a condition in which the pre-registration roller pair 121 is in contact. In the condition illustrated in FIG. 4, a distance between the roller pairs nipping the sheet S is widened as compared to the case in which the pre-registration roller pair 121 is in the contact condition. Then, not only a loop space between the first guide 126*a* and the second guide 126*b* but also a sheet conveyance path between the drawing roller pair 119 and the pre-registration roller pair 121 can be utilized as a space permitting to form the loop L2. Due to that, the twist of the sheet S as illustrated in FIG. 11 is eased as compared to the case in which the pre-registration roller pair 121 is in the contact condition.

Here, the shape of the conveyance guide 126 composing the sheet conveyance path is set to be able to suppress the sheet S from hanging by supporting a lower surface of the sheet S at an upstream side of the pre-registration roller pair 121. More specifically, a tangential line T1 passing through the nip portion of the pre-registration roller pair 121 when viewed in the width direction is disposed so as to intersect with a under guide face 126*u* of the conveyance guide 126 at the upstream side of the pre-registration roller pair 121. Still further, a maximum value of a width of the sheet conveyance path, i.e., a distance in a sheet thickness direction, at the upstream side of the pre-registration roller pair 121 is set to be smaller than a maximum width of the sheet conveyance path between the pre-registration roller pair 121 and the registration roller pair 131, i.e., to be smaller than a width of the loop space.

If the sheet S is permitted to hang down largely between the pre-registration roller pair 121 in the separate condition and the drawing roller pair 119, a part of force of the drawing roller pair 119 delivering the sheet ends up being absorbed as deflection of the hanged part. In this case, there is a possibility that the skew correcting function drops because the force of butting the leading edge of the sheet S against the nip portion of the registration roller pair 131 becomes insufficient. Meanwhile, according to the present embodiment, it is possible to ease the twist of the sheet S while assuring the skew correcting function because the sheet S butts against the registration roller pair 131 while being supporting the lower surface of the sheet S by the under guide face 126*u*.

Conveyance Control

Figure 9:
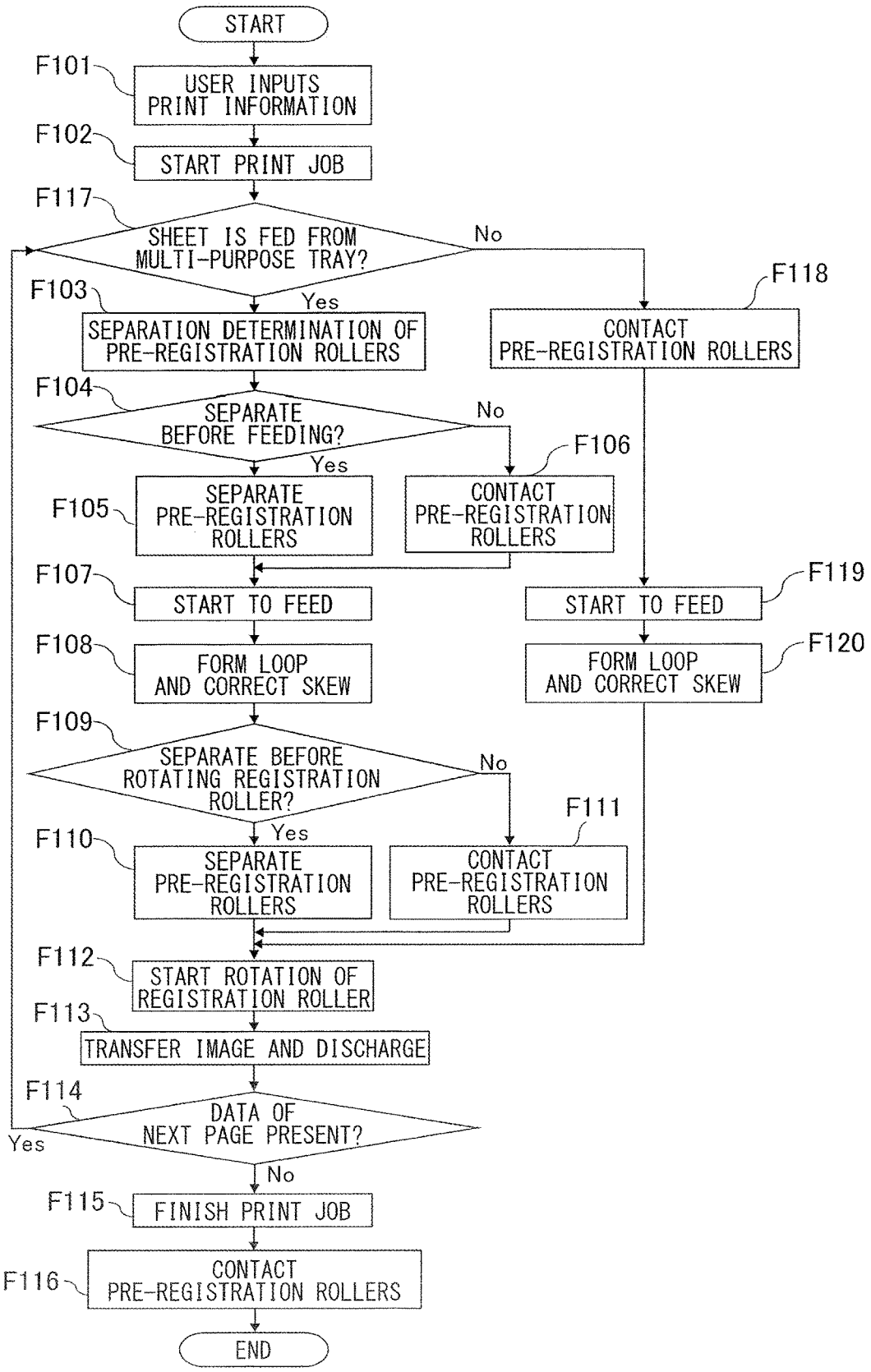
FIG. 9 is a flowchart indicating a control method of a sheet conveyance operation of the first embodiment.

A method for controlling the sheet conveyance operation of the present embodiment will be described with reference to a flowchart in FIG. 9. Note that each processing step of the flowchart described below is processed by a control program executed by the CPU 201 of the control unit 200.

Firstly, a user inputs print information such as information on a sheet to be used in forming an image and information specifying whether duplex printing is carried out through the console portion 301 in advance before inputting a task, i.e., a print job, of forming an image on s sheet to the image forming apparatus 100 in Step F101. The information on sheet to be inputted includes sheet size and grammage. That is, the console portion 301 serves as an acquisition portion for acquiring information concerning a sheet length of the sheet in the present embodiment. In a case where the image forming apparatus 100 includes a plurality of sheet supporting portions, i.e., the sheet feed cassettes 111 and the multi-purpose tray 116 in the present embodiment, the information on sheet is set for each sheet supporting portion. Based on a signal received from the console portion 301, the CPU 201 registers the information on sheet in a storage area prepared in the storage unit.

Next, as the print job is inputted to the image forming apparatus 100, the print job is started to be executed in Step F102. The input of the print job means a case where the user instructs to print by pressing a print execute button of the console portion 301 or a case where data described in a page description language is transmitted from an external computer to the image forming apparatus 100 through a network.

Next, in a case where a sheet feed portion serving as a sheet feed source is the multi-purpose tray 116, i.e., Yes in Step F117, a separation determination process of the pre-registration roller pair 121 is executed in Step F103. The separation determination process in the present embodiment is performed based on a length of the sheet in the sheet conveyance direction (referred to simply a "sheet length" hereinafter) and on grammage of the sheet. As for the timing when a separating operation is made, it is possible to select from two periods of a period before correcting a skew and a period after correcting a skew. Here, the period before correcting a skew is a period before the leading edge of the sheet is abutted against the registration roller pair 131 in the stopped condition, and the execution timing of the separating operation is set specifically at timing before feeding of the sheet is started in the present embodiment. The period after correcting a skew is a period until the registration roller pair 131 is started to be driven after the leading edge of the sheet is abutted against the registration roller pair 131.

A table in FIG. 10 indicates correspondence between combinations of determination conditions and whether the separating operation is to be executed in the separation determination process. According to the present embodiment, the separating operation is executed only in a case where the sheet length is a predetermined threshold value X [mm] or more and no separating operation is executed in a case where the sheet length is less than the threshold value. Still further, the separating operation is executed only in a case where the grammage of the sheet is less than a predetermined threshold value M [gsm: gram per square meter] and no separating operation is executed in a case where the grammage of the sheet is more than the threshold value. That is, in a case where the length and the grammage of the sheet are known, the present embodiment is set such that the separating operation is executed when the sheet length is more than the threshold value and the grammage is below the threshold value and no separating operation is executed when the sheet length is below the threshold value and the grammage is more than the threshold value.

The threshold value X is a length of a sheet that can be conveyed by the upstream conveyance roller pair, i.e., the drawing roller pair 119 or the cassette side drawing roller pair 113, even if the pre-registration roller pair 121 is separated. That is, the threshold value X is set to be a value more than a distance from the upstream conveyance roller pair to the registration roller pair 131 measured along the sheet conveyance direction. This arrangement is set to cause the sheet delivered from the upstream conveyance roller pair to arrive at the registration roller pair 131 in a condition in which the pre-registration roller pair 121 is separated in a case of executing the separating operation of the pre-registration roller pair 121 before correcting a skew. The value of the threshold value M of the grammage is set as a boundary value of a permissible range in a case where frequency of causing a wrinkle is experimentally confirmed in a case where the sheet is conveyed without separating the pre-registration roller pair 121. The values of the thresholds X and M and the correspondence indicated in FIG. 10 are stored in advance in the storage unit of the control unit 200.

Executing the separating operation, nipping of the sheet by the pre-registration roller pair 121 is released as a result, therefore it is possible to prevent the twist from increasing after the registration roller pair 131 starts to rotate. Accordingly, it is possible to reduce the occurrence of the wrinkle by executing the separating operation in the case where the sheet length is longer than the threshold value. Meanwhile, in a case of a short sheet in which the sheet length is shorter than the threshold value, the possibility of causing the wrinkle is relatively small even if the registration roller pair 131 starts to rotate while the pre-registration roller pair 121 is kept in the contact condition because a degree of change of the twist occurring during the conveyance is small as compared to a lengthy sheet. Accordingly, in this case, the pre-registration roller pair 121 is kept in the contact condition and the separating operation is omitted.

In a case where the grammage is greater than the threshold value, stiffness of the sheet is high and the sheet is relatively hardly wrinkled regardless of the sheet length. Meanwhile, in a case where the grammage is smaller than the threshold value, the possibility of causing a wrinkle due to the sheet length is liable to be actualized. Therefore, it is possible to effectively suppress the wrinkle from being generated by executing the separating operation only when the sheet length is longer than the threshold value and the grammage is less than the threshold value.

Here, an execution timing of the separating operation in the case where the sheet length is more than the threshold value and the grammage is less than the threshold value is set before correcting a skew. Due to that, after executing the separating operation, the pre-registration roller pair 121 is kept in the separate condition also after correcting the skew. In a case of feeding a plurality of sheets having equal sheet length and grammage, if the separating operation is executed in conveying a first sheet, the pre-registration roller pair 121 is kept in the separate condition until at least when a trailing edge of a final sheet passes through the position of the pre-registration roller pair 121. Therefore, in a case where a plurality of sheets is sequentially fed from one and same feeding unit in a print job, it is possible to improve the throughput as compared to an arrangement in which the separating operation and the contact operation are executed every time when one sheet is fed.

The image forming apparatus 100 of the present embodiment is also provided with a free-size mode of enabling to start a print job without requiring the user to expressly input size of a sheet set on the multi-purpose tray 116 through the console portion 301. In a case where the size of the sheet set on the multi-purpose tray 116 is unknown or indefinite as indicated in Table 10, i.e., in a case where the CPU 201 cannot specify a sheet size even if the CPU 201 refers to a signal or the like received from the console portion 301, the separation determination process is executed corresponding to the grammage. In this case, no separating operation is executed in a case where the grammage is greater than the threshold value M, and the separating operation is executed in a case where the grammage is below the threshold value M.

Here, in a case where the separating operation is executed when the sheet length is unknown, an execution timing of the separating operation is set at a timing after correcting a skew and the pre-registration roller pair 121 is set in the contact condition before correcting the skew. Because the pre-registration roller pair 121 is in contact with each other before correcting the skew, the correction of the skew can be made stably regardless of the sheet length. Still further, although there is a case where an actual sheet length exceeds the abovementioned threshold value X because the sheet length is unknown, it is possible to reduce the possibility of causing the wrinkle on the sheet by executing the separating operation after correcting the skew in a case where the grammage is less than the threshold value M. Meanwhile, for a sheet having a grammage greater than the threshold value M, the possibility of causing a wrinkle is low and the separating operation is omitted.

Based on the result of the abovementioned separation determination process, the operation of the pre-registration roller pair 121 in conveying the sheet is controlled. In FIG. 9, in a case where the pre-registration roller pair 121 is determined to be the separate condition before correcting a skew, i.e., Yes in Step F104 as a result of the separation determination process in Step F103, the separating operation is executed in Step F105. In a case where the pre-registration roller pair 121 is determined to be the contact condition before correcting a skew, i.e., No in Step F104, the contact operation is executed in Step F106. According to the present embodiment, these separating operations in Step F105 and the contact operation in Step F106 are executed before starting to feed the sheet. In a case of executing the separating operation and the contact operation, the CPU 201 rotates the pre-registration driving motor 145 in the CCW direction and stops the pre-registration driving motor 145 after confirming that the detection result of the separation sensor 129 has been changed.

Note that in a case where it is detected that the pre-registration roller pair 121 has been already in the separate condition from the detection result of the separation sensor 129 before executing Step F105, the separate condition of the pre-registration roller pair 121 is maintained without executing the separating operation. In the same manner, in a case where it is detected that the pre-registration roller pair 121 has been already in the contact condition before executing Step F106, the pre-registration roller pair 121 is maintained in the contact condition without executing the contact operation.

Next, as the sheet feed unit 117 of the multi sheet feed portion 115 is started to drive, the sheet is started to be fed from the multi-purpose tray 116 in Step F107. The sheet is conveyed while being nipped by the drawing roller pair 119, is abutted against the registration roller pair 131 in the stopped condition via the pre-registration roller pair 121 in the contact condition or the separate condition and forms a loop in Step F108. If the pre-registration roller pair 121 is in the separate condition at this time, the leading edge of the sheet is abutted against the registration roller pair 131 by being conveyed by the drawing roller pair 119.

After that, in accordance with a determination result in Step F103, it is determined whether the pre-registration roller pair 121 is separated after correcting a skew in Step F109. In a case where it has been determined that the pre-registration roller pair 121 is put into the separate condition after correcting a skew, i.e., Yes in Step F109, the separating operation is executed in Step F110. In a case where it has been determined that the pre-registration roller pair 121 is put into the contact condition also after correcting a skew, i.e., No in Step F109, the pre-registration roller pair 121 is kept in the contact condition in Step F111. According to the present embodiment, these separating operation in Step F110 or the contact operation in Step F111 are executed before the registration roller pair 131 starts to rotate. Still further, in a case where it is detected that the pre-registration roller pair 121 has been already in the separate condition, no separating operation is executed.

If it is confirmed that the pre-registration roller pair 121 is in a condition set as being a condition after correcting a skew, the registration roller pair 131 is started to rotate at a timing synchronized with a progress of a toner image forming process of the image forming unit 150 in Step F112. If the pre-registration roller pair 121 is in the contact condition at this time, the pre-registration driving motor 145 is controlled so as to start to rotate in the CW direction simultaneously with the start of rotation of the registration driving motor 133. Still further, in a case where the sheet length is longer than the distance from the drawing roller pair 119 to the registration roller pair 131, the drawing driving motor 120 is also controlled so as to start to rotate simultaneously with the start of rotation of the registration driving motor 133. After that, a toner image is secondarily transferred from the intermediate transfer belt onto the sheet which passes through the secondary transfer portion. Then, after fixing the image by the fixing unit 160, the sheet is discharged out of the image forming apparatus in Step F113.

Then, in a case where there is data of a next page, i.e., Yes in Step F114, it is determined whether a feed source, i.e., a feed portion from which a sheet is fed, of the next sheet is the multi-purpose tray 116 in Step F117 and in a case where it is the multi-purpose tray 116, the processes of Steps F103 through F113 are repeated. If there is no next page, the print job is finished in Step F115, and the contact operation is executed to return the pre-registration roller pair 121 to the contact position which is an initial position in Step F116.

Note that in a case where the feed source is other than the multi-purpose tray 116 in Step F117, no separation determination process of the pre-registration roller pair 121 is executed and the pre-registration roller pair 121 is set in the contact condition in Step F118. If the pre-registration roller pair 121 is in the separate condition at this time, the contact operation is executed. No contact operation is executed if the pre-registration roller pair 121 is already in the contact condition. After that, the sheet is started to be fed in Step F119 and the leading edge of the sheet butts against the registration roller pair 131 in the stopped condition to correct a skew in Step F120. Then, the registration roller pair 131 starts to rotate in Step F112 and a series of operations of transferring an image and of discharging the sheet are executed in Step F113.

Figure 12:
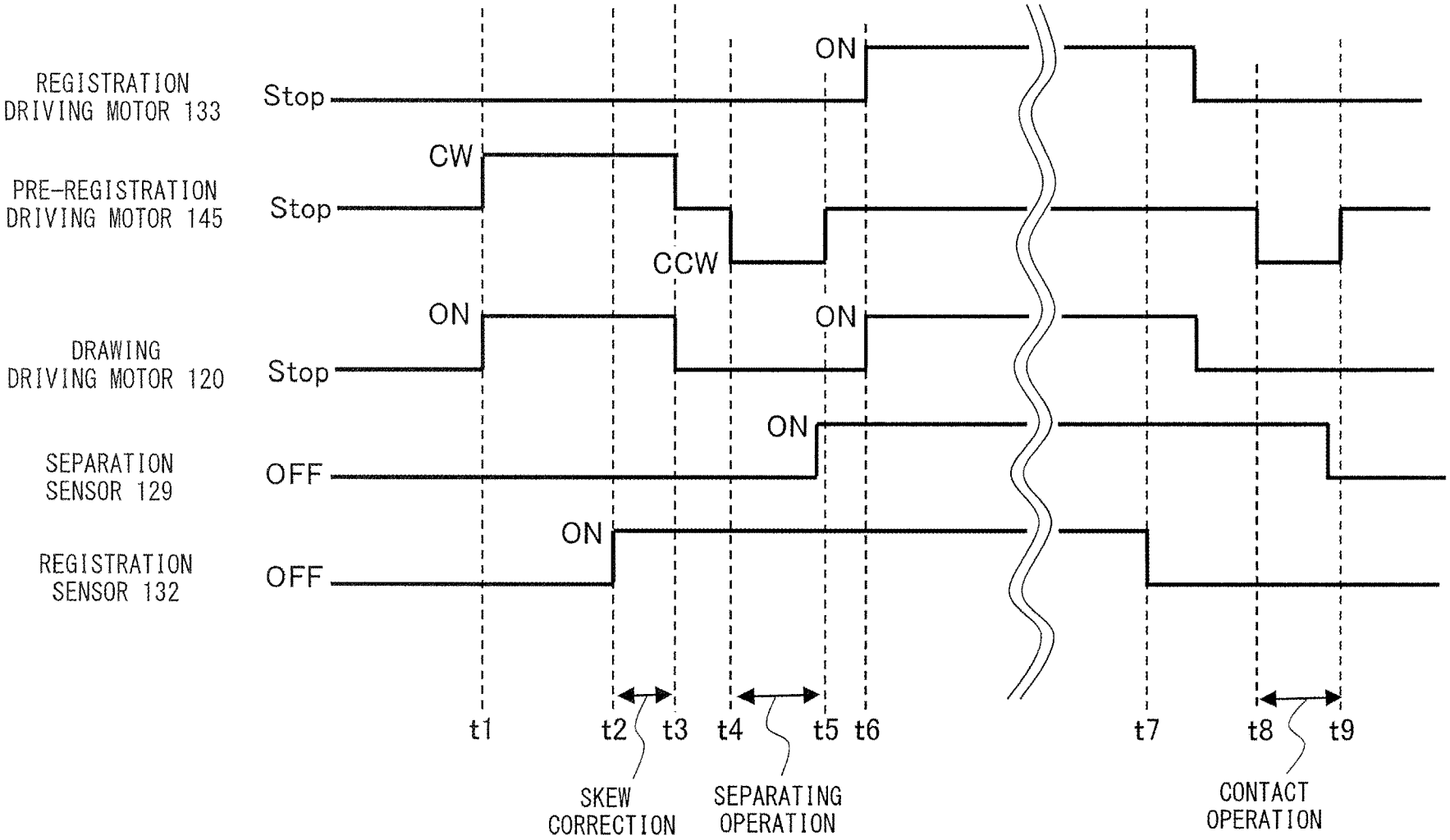
FIG. 12 is a timing chart of the sheet conveyance operation of the first embodiment.

Next, one exemplary sheet conveyance operation executed in accordance to the control method of the present embodiment will be described with reference to a timing chart in FIG. 12. This timing chart indicates an operation in a case where it is determined by the separation determination process of the pre-registration roller pair 121 in Step F103 such that the pre-registration roller pair 121 is put in the contact condition before correcting a skew and the pre-registration roller pair 121 is put in the separate condition after correcting a skew.

After the print job is inputted to the image forming apparatus 100 and the sheet is started to be fed, the drawing driving motor 120 and the pre-registration driving motor 145 are started to be driven at time t1. Because the pre-registration roller pair 121 is set to be in the contact condition here, the pre-registration driving motor 145 is rotated in the CW direction. After that, the leading edge of the sheet arrives at the detection position of the registration sensor 132 and the registration sensor 132 detects the sheet and changes from OFF to ON at time t2. The drawing driving motor 120 and the pre-registration driving motor 145 stop at time t3 after an elapse of a predetermined time since when the registration sensor 132 has detected the sheet. The leading edge of the sheet butts against the registration roller pair 131 in the stopped condition and thus the skew of the sheet is corrected during the times t2 through t3.

After that, the pre-registration driving motor 145 rotates in the CCW direction at time t4 before the registration roller pair 131 is started to rotate, and the pre-registration driving motor 145 stops at time t5 after the separation sensor 129 has changed from OFF to ON. That is, the separating operation is started at time t4 and is finished at time t5. Thereby, the pre-registration roller pair 121 is switched over from the contact condition to the separate condition.

In succession, the registration driving motor 133 starts to rotate at time t6 and the drawing driving motor 120 starts to rotate simultaneously. Thereby, the sheet is fed from the registration roller pair 131 to the secondary transfer portion. It is noted that because the pre-registration roller pair 121 is separated in this case, the pre-registration driving motor 145 is stopped even after the registration driving motor 133 rotates. In a case where a condition of the pre-registration roller pair 121 after correcting a skew is set to be the contact condition, the pre-registration driving motor 145 is rotated in the CW direction simultaneously with the start of rotation of the registration driving motor 133.

After that, as the trailing edge of the sheet passes through the detection position of the registration sensor 132 and the registration sensor 132 changes from ON to OFF at time t7, the drawing driving motor 120 and the registration driving motor 133 are stopped. After that, when it is determined that the print job has finished, the pre-registration driving motor 145 starts to rotate in the CCW direction at time t8 and stops at time t9 after the separation sensor 129 changed from ON to OFF. Thereby, the pre-registration roller pair 121 is switched over from the separate condition to the contact condition.

SUMMARY OF PRESENT EMBODIMENT

As described above, according to the present embodiment, the mode of executing the separating operation of the pre-registration roller pair 121 in conveying the sheet, i.e., the second mode, and the mode of conveying the sheet without executing the separating operation, i.e., the first mode, is switched over based on the length of the sheet in the sheet conveyance direction. This arrangement makes it possible to prevent the wrinkle from being generated by executing the separating operation in the case where the wrinkle is liable to be generated and, in the same time, to improve a throughput by omitting the separating operation in the case where no wrinkle is liable to occur. That is, the arrangement of the present embodiment makes it possible to improve the throughput of the sheet conveyance apparatus while preventing the occurrence of the wrinkle and to eventually improve productivity of the image forming apparatus.

In particular, the present embodiment is arranged such that the correction of the skew of the sheet is executed by the upstream drawing roller pair 119 in the condition in which the pre-registration roller pair 121 is separated before correcting a skew in the second mode. Then, it is determined whether the separating operation is to be executed by using the threshold value X corresponding to the distance from the drawing roller pair 119 to the registration roller pair 131. That is, the first mode is executed in conveying a first sheet which is shorter than the distance from the upstream roller pair to the second roller pair, while the second mode is executed in conveying a second sheet longer than the abovementioned distance. This arrangement makes it possible to realize a stable sheet conveyance. It is noted that instead of such arrangement, it is also possible to execute the separating operation after correcting a skew and to set the threshold value X to be a value smaller than the distance from the drawing roller pair 119 to the registration roller pair 131.

Still further, according to the present embodiment, the first and second modes are changed over also based on the grammage of the sheet in addition to the sheet length. That is, according to the present embodiment, the first mode is executed in conveying a third sheet having a length, in terms of the sheet conveyance direction, equal with the above-mentioned second sheet on which the second mode is executed and having a grammage smaller than that of the second sheet. In other words, in a case where the first mode is executed in conveying the third sheet having the length, in terms of the sheet conveyance direction, is longer than the distance from the upstream roller pair to the second roller pair and having the first grammage, the second mode is executed in conveying a fourth sheet having a length equal to that of the third sheet and a second grammage smaller than the first grammage. This arrangement makes it possible to reduce the wrinkle without executing more separating operation than is necessary.

By the way, according to the present embodiment, a driving source for rotationally driving the pre-registration roller pair 121 and a driving source of the separating mechanism 140 are realized by the pre-registration driving motor 145 as a single unit, so that the rotational drive of the pre-registration roller pair 121 is stopped during when the separating operation or the contact operation is executed. In such arrangement, if the separating operation is executed every time on the way of conveyance of the sheet as illustrated in FIG. 12, it is concerned that the throughput may significantly drop. Meanwhile, the arrangement of the present embodiment makes it possible to minimize the drop of the throughput because no more separating operation than is necessary is executed.

In a case where the sheet length is indefinite, the present embodiment is also arranged to be able to execute the third mode of executing the separating operation after correcting a skew, i.e., the case of the column of Free-Size and a grammage is less than the threshold value M in FIG. 10. This arrangement makes it possible to reduce a wrinkle of a long sheet while stably conveying both long and short sheets.

Modified Examples

It is noted that while the table in FIG. 10 has been exemplified as the conditions of executing the separation determination process of the pre-registration roller pair 121, other determination conditions may be used. For instance, it is also possible to determine whether the separating operation of the pre-registration roller pair 121 is executed by preparing a plurality of threshold values of grammage of a sheet and based on likelihood of occurrence of a wrinkle presumed from combinations of the sheet length and the grammages. In other words, setting of the conditions of the separation determination process can be appropriately changed by considering a balance between the reduction of the possibility of causing the wrinkle and the improvement of the throughput.

Still further, an arrangement in which the console portion 301 which is one example of an input portion to the image forming apparatus 100 is used as the acquisition portion for acquiring information concerning the sheet length has been illustrated in the present embodiment. Instead of that, it is also possible to dispose a sensor capable of discriminating the sheet length by sensing a swing of a flag projecting on the multi-purpose tray 116 and to determine whether the separating operation is executed based on a detection result of the sensor.

Still further, the arrangement in which the driving source for rotationally driving the pre-registration roller pair 121 and the driving source of the separating mechanism 140 are realized by the single unit has been illustrated in the present embodiment. However, even if these driving sources are provided separately, there is a case where the progress of the sheet conveyance operation is restricted by the separating operation or the contact operation of the pre-registration roller pair 121. For instance, in the case of separating the pre-registration roller pair 121 before correcting a skew, it is preferable to complete the separating operation before the leading edge of the sheet arrives at the position of the pre-registration roller pair 121 in order to avoid the leading edge of the sheet from being caught. Therefore, even if the driving sources are provided separately, it is possible to improve the throughput in a case where the progress of the sheet conveyance operation is quickened by applying the arrangement of not executing more separating operation than is necessary like the present embodiment.

Still further, it is possible to reduce a number of motors and hence to lower the cost by eliminating the drawing driving motor 120 and by arranging such that the pre-registration driving motor 145 rotates also the drawing roller pair 119 in addition to the pre-registration roller pair 121. While the drive of the drawing roller pair 119 is also stopped during when the separating mechanism 140 is driven by rotating the pre-registration driving motor 145 in the CCW direction in this arrangement, it is possible to suppress a drop of the throughput by arranging such that no more separating operation than is necessary is executed like the present embodiment.

Second Embodiment

Figure 13:
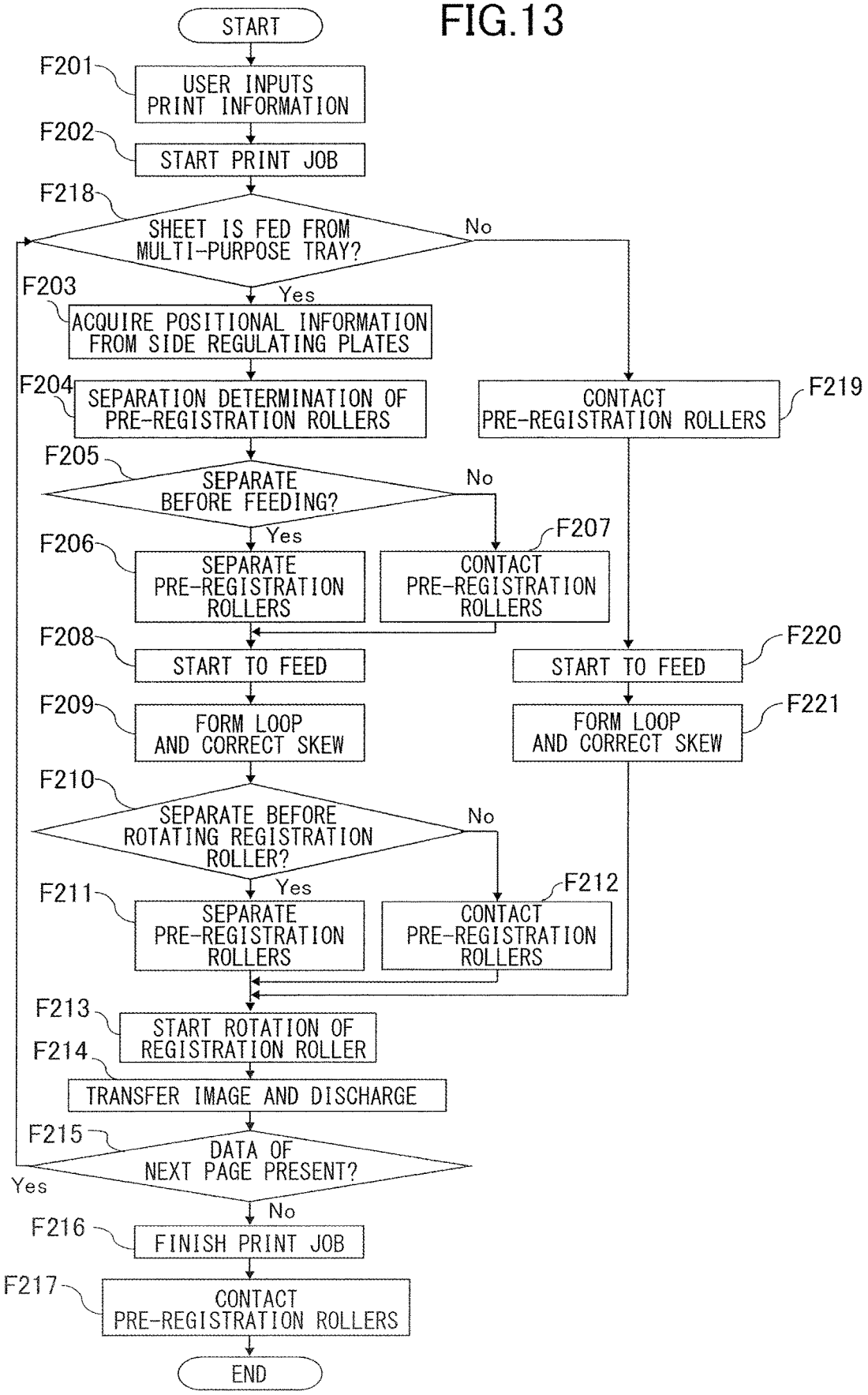
FIG. 13 is a flowchart indicating a control method of a sheet conveyance operation of a second embodiment.
Figure 14:
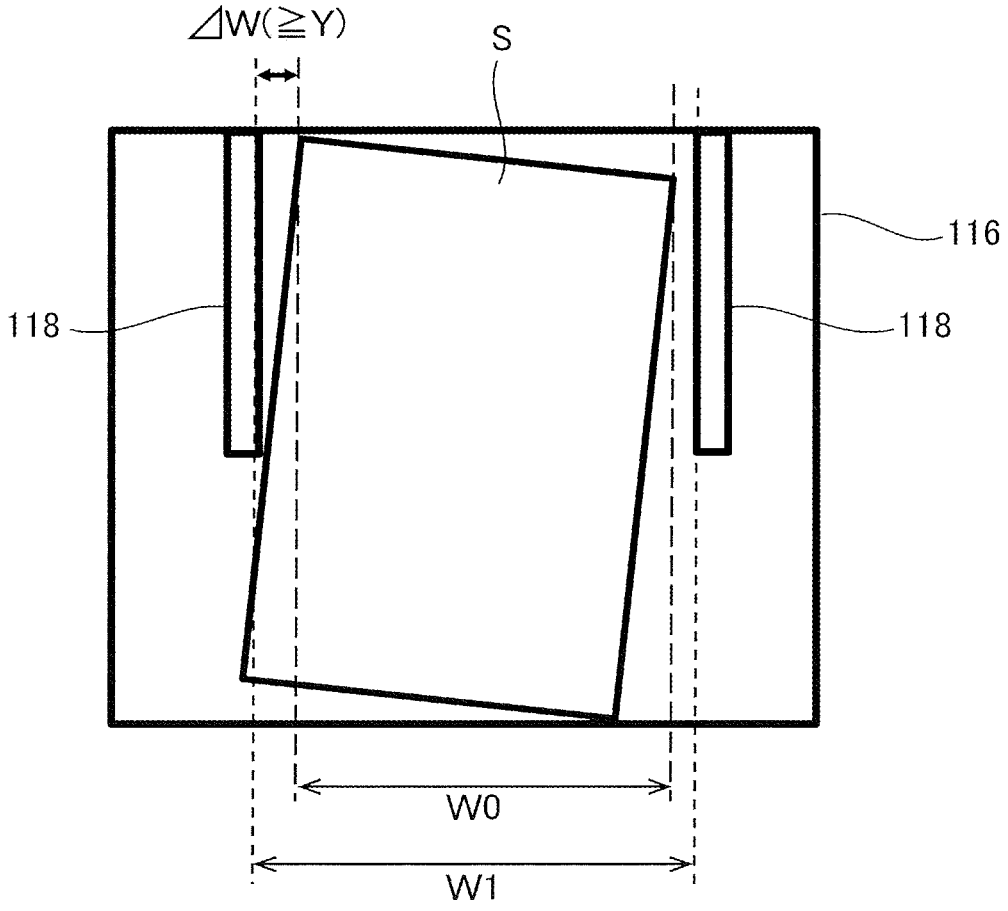
FIG. 14 is a schematic diagram illustrating a multi-purpose tray of the image forming apparatus of the second embodiment.
Figure 15:
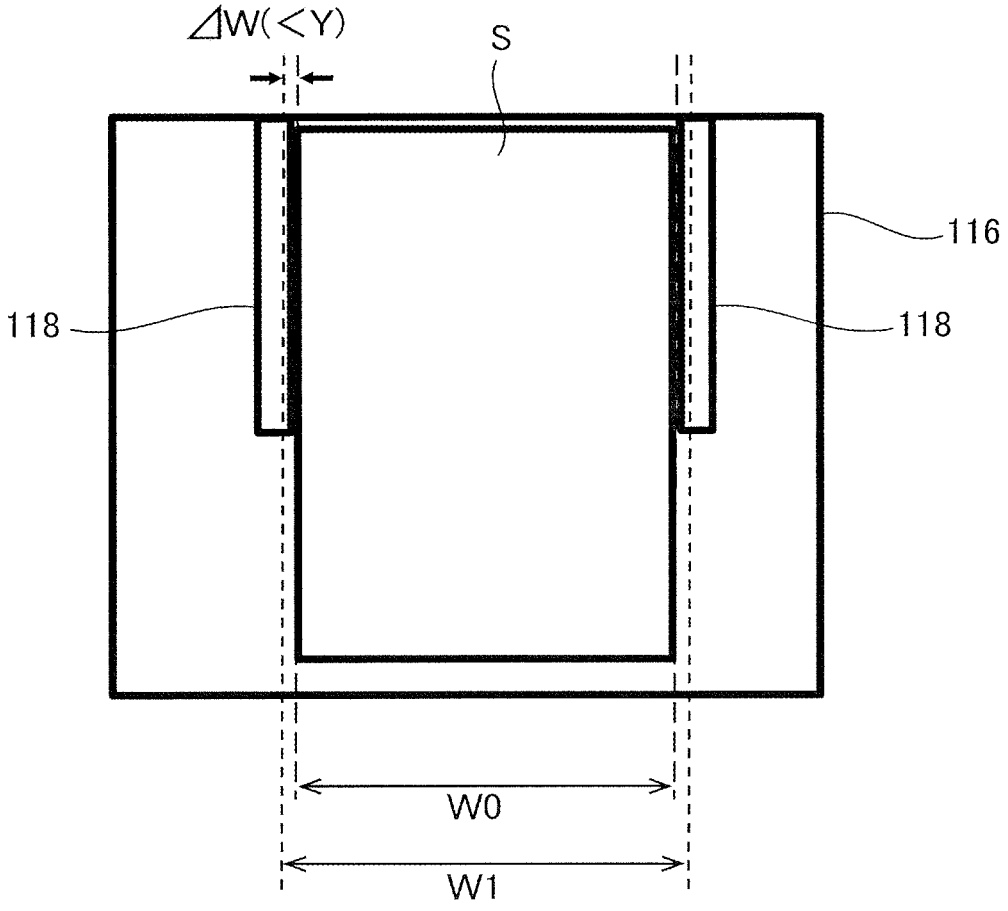
FIG. 15 is another schematic diagram illustrating a multi-purpose tray of the image forming apparatus of the second embodiment.

Next, a sheet conveyance apparatus of a second embodiment will be described. The present embodiment is different from the first embodiment in terms of a control method of the sheet conveyance operation. The other components having the substantially same configurations and operations with those of the first embodiment will be denoted by the common reference numerals and their description will be omitted. FIG. 13 is a flowchart indicating the control method of the sheet conveyance operation of the present embodiment. FIGS. 14 and 15 are schematic diagrams describing standards for determining whether the separating operation of the pre-registration roller pair 121 should be executed in the present embodiment.

According to the present embodiment, it is determined whether the separating operation of the pre-registration roller pair 121 is executed based on differences between positional information of side regulating plates regulating widthwise position by abutting with edges of the sheet set in the multi-purpose tray 116 and a width of the sheet specified by the user. As illustrated in FIG. 14, in a case where a difference between a width W0 of the designated sheet and a width W1 of the side regulating plates 118 and 118, i.e., $\Delta W = W1 - W0$, is large, the sheet S is supposed to be placed manually with a skew with respect to the multi-purpose tray 116. In such a case, a possibility of causing a wrinkle increases because the sheet S generates a large twist along with the correction of a skew. Meanwhile, if a difference $\Delta W$ between the width W0 of the designated sheet and the width W1 of the side regulating plates 118 and 118 is small as illustrated in FIG. 15, the possibility of causing the wrinkle is lowered because the twist of the sheet S along with the correction of a skew becomes small. Then, according to the present embodiment, it is determined whether the separating operation is executed by comparing the difference $\Delta W$ between the width W0 of the designated sheet and the width W1 of the side regulating plates 118 and 118 with a threshold value Y [mm] set in advance.

The width W1 of the side regulating plates 118 and 118 can be detected by the multi-size sensor 134 in FIG. 2 serving as a detection portion of the present embodiment. A sensor that outputs a signal that continuously changes corresponding to the distance between the side regulating plates is used as the multi-size sensor 134. For instance, in an arrangement in which a pair of side regulating plates is interconnected through a rack-and-pinion mechanism, a variable resistor, i.e., a volume sensor, attached to the pinion gear may be used as the multi-size sensor 134.

The control method of the sheet conveyance operation of the present embodiment will be described along a flowchart in FIG. 13. Each step of the flowchart is processed by a control program executed by the CPU 201 of the control unit 200 in FIG. 2.

Firstly, before inputting a print job to the image forming apparatus 100, the user inputs print information including sheet information to the image forming apparatus 100 through the console portion 301 in Step F201. The inputted sheet information includes at least information specifying a width of the sheet such as a value indicating a regular size such as 'A4' and 'legal' or numerical values indicating a width and a length of the sheet. In a case where the image forming apparatus 100 includes a plurality of sheet supporting portions, i.e., the sheet feed cassettes 111 and the multi-purpose tray 116 in the present embodiment, the sheet information is set for each sheet supporting portion. Based on a signal received from the console portion 301, the CPU 201 registers the information on sheet in a storage area prepared in the storage unit.

Next, as the print job is inputted to the image forming apparatus 100, the print job is started to be executed in Step F 202. In a case where the feed portion serving as a sheet supply source is the multi-purpose tray 116, i.e., Yes in Step F218, the CPU 201 acquires the positional information of the side regulating plates 118 and 118 by making reference to the detection result of the multi-size sensor 134 in Step F203 and executes the separation determination process of the pre-registration roller pair in Step F204.

In the separation determination process, the CPU 201 compares the difference ΔW between the width W1 of the side regulating plates 118 and 118 and the width W0 of the sheet size registered as the sheet information of the multi-purpose tray 116 with the threshold value Y. In a case where the difference ΔW is larger than the threshold value Y, i.e., $\Delta W \geq Y$, a possibility of causing a wrinkle is high, so that it is determined to be necessary to execute the separating operation. Meanwhile, in a case where the difference ΔW is less than the threshold value Y, i.e., $\Delta W < Y$, a possibility of causing a wrinkle is low, so that it is determined to be unnecessary to execute the separating operation. In the separation determination process, it is also determined by which the separating operation is to be executed, i.e., before or after correcting a skew. Note that the threshold value Y is set as a boundary value by which occurrence frequency of wrinkle stays within an allowable range by investigating frequency of occurrence of wrinkle in conveying the sheet without executing the separating operation after setting the sheet in a condition of being askew on the multi-purpose tray 116. The value of the threshold value Y is stored in advance in the storage unit of the control unit 200.

Based on the determination result in Step F204, the operation of the pre-registration roller pair 121 in conveying the sheet is controlled. As a result of the separation determination process, in a case where it is determined to put the pre-registration roller pair 121 into the separate condition before correcting a skew, i.e., Yes in Step F205, the separating operation is executed in Step F206. In a case where it is determined to put the pre-registration roller pair 121 into the contact condition before correcting a skew, i.e., No in Step F205, the contact operation is executed in Step F207. Note that in a case where it is detected that the pre-registration roller pair 121 is already in the separate condition from the detection result of the separation sensor 129 before executing Step F206, no separating operation is executed. In the same manner, in a case where it is detected that the pre-registration roller pair 121 is already in the contact condition before executing the Step F207, no contact operation is executed.

Next, as the sheet feed unit 117 of the multi sheet feed portion 115 started to be driven, the sheet is started to be fed from the multi-purpose tray 116 in Step F208. The sheet is conveyed while being nipped by the drawing roller pair 119, is abutted against the registration roller pair 131 in the stopped condition via the pre-registration roller pair 121 in the contact condition or the separate condition and forms a loop in Step F209. If the pre-registration roller pair 121 is in the separate condition at this time, the leading edge of the sheet butts against the registration roller pair 131 by being conveyed by the drawing roller pair 119.

After that, in accordance to a determination result in Step F204, it is determined whether the pre-registration roller pair 121 is separated after correcting a skew in Step F210. In a case where it has been determined that the pre-registration roller pair 121 is put into the separate condition after correcting a skew, i.e., Yes in Step F210, the separating operation is executed in Step F211. In a case where it has been determined that the pre-registration roller pair 121 is put into the contact condition also after correcting a skew, i.e., No in Step F210, the pre-registration roller pair 121 is kept in the contact condition in Step F212. In a case where it is detected that the pre-registration roller pair 121 has been already in the separate condition, no separating operation is executed.

Note that while it is selectable to execute the separating operation before or after correcting a skew, it is conceivable to determine that based on a sheet length in the sheet conveyance direction in the same manner with the first embodiment. That is, if the sheet length is more than the abovementioned threshold value X, the separating operation is executed before correcting a skew in Step F206 and if the sheet length is less than the threshold value X or is indefinite, the separating operation is executed after correcting a skew in Step F211. That is, it is possible to combine the determination condition of the first embodiment with the determination condition of the present embodiment concerning the separating operation.

If it is confirmed that the pre-registration roller pair 121 is in a condition set as being a condition after correcting a skew, the registration roller pair 131 is started to rotate at a timing synchronized with a progress of a toner image forming process of the image forming unit 150 in Step F213. After that, a toner image is secondarily transferred from the intermediate transfer belt onto the sheet which passes through the secondary transfer portion. Then, after fixing the image by the fixing unit 160, the sheet is discharged out of the image forming apparatus in Step F214.

Then, in a case where there is data of a next page, i.e., Yes in Step F215, it is determined whether a feed source of the next sheet is the multi-purpose tray 116 in Step F218 and in a case where it is the multi-purpose tray 116, the processes of Steps F203 through F214 are repeated. If there is no next page, the print job is finished in Step F216, and the contact operation is executed to return the pre-registration roller pair 121 to the contact position which is an initial position in Step F217.

Note that in a case where the feed source is other than the multi-purpose tray 116 in Step F218, no separation determination process of the pre-registration roller pair 121 is executed and the pre-registration roller pair 121 is set in the contact condition in Step F219. If the pre-registration roller pair 121 is in the separate condition at this time, the contact operation is executed. No contact operation is executed if the pre-registration roller pair 121 is already in the contact condition. After that, the sheet is started to be fed in Step F220 and the leading edge of the sheet is abutted against the registration roller pair 131 in the stopped condition to correct a skew in Step F221. Then, the registration roller pair 131 starts to rotate in Step F213 and a series of operations of transferring an image and of discharging the sheet are executed in Step F214.

As described above, according to the present embodiment, the mode of the sheet conveyance operation is changed corresponding to the difference ΔW between the width of the designated sheet and the width of the side regulating plates 118 acquired as the detection result of the sensor. In a case where the difference ΔW is greater than the threshold value Y, the mode of executing the separating operation of the pre-registration roller pair 121, i.e., the second mode, is selected. Meanwhile, in a case where the difference ΔW is less than the threshold value Y, the mode of conveying the sheet without executing the separating operation, i.e., the first mode, is selected. This arrangement makes it possible to improve the throughput while preventing an occurrence of a wrinkle by executing the separating operation in a case where the wrinkle is liable to occur and by eliminating the separating operation in a case where no wrinkle is liable to occur in the same manner with the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-217708, filed on Nov. 20, 2018, which is hereby incorporated by reference herein in its entirety.

What is claimed is:

1. A sheet conveyance apparatus comprising:

a first roller pair configured to form a nip portion for nipping and conveying a sheet;

a second roller pair disposed downstream of the first roller pair in a sheet conveyance direction and configured to convey the sheet;

a third roller pair disposed upstream of the first roller pair in the sheet conveyance direction and configured to convey the sheet;

a switching mechanism configured to switch the first roller pair to a contact state in which the nip portion is formed and a released state in which the nip portion is released;

an acquisition portion configured to acquire information concerning a sheet length in the sheet conveyance direction and a sheet grammage; and a control portion configured to control the switching mechanism based on the information concerning the sheet length and the sheet grammage, wherein the control portion is configured to execute:

in a case of conveying a first sheet of which the sheet length is a first length, a first mode in which a leading edge of a sheet conveyed by the first roller pair is abutted against the second roller pair in a state in which the first roller pair is in the contact state and a rotation of the second roller pair is stopped, and then the second roller pair starts rotating in a state in which the first roller pair is in the contact state, in a case of conveying a second sheet of which the sheet length is a second length greater than the first length and of which the sheet grammage is a first grammage, the first mode, and in a case of conveying a third sheet of which the sheet length is the second length and of which the sheet grammage is a second grammage smaller than the first grammage, a second mode in which a leading edge of a sheet conveyed by the third roller pair is abutted against the second roller pair in a state in which the first roller pair is in the released state and a rotation of the second roller pair is stopped, and then the second roller pair starts rotating in a state in which the first roller pair is in the released state.

2. The sheet conveyance apparatus according to claim 1, wherein the control portion is configured to execute:

the first mode in a case where the sheet length is shorter than a distance from the third roller pair to the second roller pair, and either the first mode or the second mode in accordance with the sheet grammage in a case where the sheet length is longer than the distance.

3. The sheet conveyance apparatus according to claim 1, wherein the control portion is further configured to execute a third mode in which a leading edge of a sheet conveyed by the third roller pair is abutted against the second roller pair in a state in which the first roller pair is in the contact state and a rotation of the second roller pair is stopped, and then the second roller pair starts rotating in a state in which the first roller pair is in the released state.

4. The sheet conveyance apparatus according to claim 3, wherein the control portion is configured to execute the third mode in a case where the information acquired by the acquisition portion indicates that the sheet length is indefinite.

5. The sheet conveyance apparatus according to claim 1, wherein the acquisition portion comprises an input portion that enables to input the information concerning the sheet length and the sheet grammage.

6. The sheet conveyance apparatus according to claim 1, wherein in a case where the control portion executes the second mode for a first one among a plurality of sheets in executing a job of sequentially conveying the plurality of sheets, the control portion executes the second mode for other sheets among the plurality of sheets in a state in which the first roller pair is kept in the released state.

7. The sheet conveyance apparatus according to claim 1, further comprising:

a cassette stored in an apparatus body in a state in which sheets are stacked in the cassette; and a manual feed tray on which sheets are set manually, wherein the control portion is configured to execute either the first mode or the second mode based on the information concerning the sheet length and the sheet grammage acquired by the acquisition portion in a case of conveying a sheet fed from the manual feed tray and to execute the first mode in a case of conveying a sheet fed from the cassette.

8. The sheet conveyance apparatus according to claim 1, further comprising a motor connected to the first roller pair and the switching mechanism, rotatable in a first direction and in a second direction opposite to the first direction, and configured to rotate in the first direction to drive the first roller pair and to rotate in the second direction to drive the switching mechanism.

9. An image forming apparatus comprising:

an image forming unit configured to form an image on a sheet; and a sheet conveyance apparatus configured to convey the sheet to the image forming unit, wherein the sheet conveyance apparatus comprises:

a first roller pair configured to form a nip portion for nipping and conveying a sheet;

a second roller pair disposed downstream of the first roller pair in a sheet conveyance direction and configured to convey the sheet;

a third roller pair disposed upstream of the first roller pair in the sheet conveyance direction and configured to convey the sheet;

a switching mechanism configured to switch the first roller pair to a contact state in which the nip portion is formed and a released state in which the nip portion is released;

an acquisition portion configured to acquire information concerning a sheet length in the sheet conveyance direction and a sheet grammage; and a control portion configured to control the switching mechanism based on the information concerning the sheet length and the sheet grammage, wherein the control portion is configured to execute:

in a case of conveying a first sheet of which the sheet length is a first length, a first mode in which a leading edge of a sheet conveyed by the first roller pair is abutted against the second roller pair in a state in which the first roller pair is in the contact state and a rotation of the second roller pair is stopped, and then the second roller pair starts rotating in a state in which the first roller pair is in the contact state, in a case of conveying a second sheet of which the sheet length is a second length greater than the first length and of which the sheet grammage is a first grammage, the first mode, and in a case of conveying a third sheet of which the sheet length is the second length and of which the sheet grammage is a second grammage smaller than the first grammage, a second mode in which a leading edge of a sheet conveyed by the third roller pair is abutted against the second roller pair in a state in which the first roller pair is in the released state and a rotation of the second roller pair is stopped, and then the second roller pair starts rotating in a state in which the first roller pair is in the released state.

10. A sheet conveyance apparatus comprising:

a sheet supporting portion configured to support a sheet;

a first roller pair configured to convey the sheet fed from the sheet supporting portion;

a second roller pair disposed downstream of the first roller pair in a sheet conveyance direction and configured to convey the sheet;

an upstream roller pair disposed upstream of the first roller pair in the sheet conveyance direction and configured to convey the sheet;

a separating mechanism configured to separate the first roller pair from each other;

a regulating portion configured to be in contact with an edge of the sheet supported on the sheet supporting portion in a width direction and regulate a position of the sheet in the width direction;

a detection portion configured to detect a position of the regulating portion in the width direction;

an input portion enabling to input information concerning a sheet width of the sheet in the width direction; and a control portion configured to control a conveyance operation of starting to rotate the second roller pair after a leading edge of the sheet in the sheet conveyance direction is abutted against the second roller pair in a stopped condition, wherein the control portion is configured to execute a first mode of rotating the upstream roller pair and the first roller pair to convey the sheet in a condition in which the first roller pair is in a contact condition so that the leading edge of the sheet is abutted against the second roller pair in the stopped condition in a first case where a difference between the sheet width inputted through the input portion and the position of the regulating portion detected by the detection portion is a first value, and wherein the control portion is configured to execute a second mode of operating the separating mechanism to separate the first roller pair and of rotating the upstream roller pair to convey the sheet in a condition in which the first roller pair is separated so that the leading edge of the sheet is abutted against the second roller pair in the stopped condition in a second case where the difference between the sheet width inputted through the input portion and the position of the regulating portion detected by the detection portion is a second value greater than the first value.

11. The sheet conveyance apparatus according to claim 10, wherein the regulating portion is a pair of regulating plates movable in the width direction, and wherein the control portion is configured to execute the first mode in a case where a difference between the sheet width inputted through the input portion and a distance between the pair of regulating plates detected by the detection portion is smaller than a predetermined threshold value and to execute the second mode in a case where the difference is greater than the threshold value.

12. The sheet conveyance apparatus according to claim 10, further comprising a cassette stored in an apparatus body in a condition in which where sheets are stacked in the cassette, wherein the sheet supporting portion is a manual feed tray on which sheets are set manually, wherein the control portion is configured to execute either the first mode or the second mode based on the sheet width inputted through the input portion and on the position of the regulating portion detected by the detection portion in a case of conveying the sheet fed from the manual feed tray and to execute the first mode in a case of conveying the sheet fed from the cassette.

13. The sheet conveyance apparatus according to claim 10, further comprising a motor connected to the first roller pair and the separating mechanism and configured to rotate in a first direction and in a second direction opposite to the first direction, such that the motor rotates in the first direction to drive the first roller pair and rotates in the second direction to drive the separating mechanism.

14. The sheet conveyance apparatus according to claim 10, wherein the control portion is configured to execute the first mode in a case where the difference between the sheet width inputted through the input portion and the position of the regulating portion detected by the detection portion is less than a predetermined threshold value, and to execute the second mode in a case where the difference between the sheet width inputted through the input portion and the position of the regulating portion detected by the detection portion is equal to or larger than the predetermined threshold value.

* * * * *